US007479061B2

(12) United States Patent
Okada

(10) Patent No.: US 7,479,061 B2
(45) Date of Patent: Jan. 20, 2009

(54) GAMING MACHINE

(75) Inventor: Kazuo Okada, Tokyo (JP)

(73) Assignee: ARUZE Corporation, Tokyo (JP)

( * ) Notice: Subject to any disclaimer, the term of this patent is extended or adjusted under 35 U.S.C. 154(b) by 751 days.

(21) Appl. No.: 10/697,942

(22) Filed: Oct. 31, 2003

(65) Prior Publication Data

US 2004/0209671 A1 Oct. 21, 2004

(51) Int. Cl.
*A63F 9/24* (2006.01)

(52) U.S. Cl. ..... 463/20

(58) Field of Classification Search ..... 463/33, 463/16

See application file for complete search history.

(56) References Cited

U.S. PATENT DOCUMENTS

| | | | | |
|---|---|---|---|---|
| 5,506,629 | A * | 4/1996 | Kawahara et al. | 348/776 |
| 5,752,881 | A * | 5/1998 | Inoue | 463/20 |
| 6,135,884 | A * | 10/2000 | Hedrick et al. | 463/20 |
| 6,315,666 | B1 * | 11/2001 | Mastera et al. | 463/31 |
| 6,517,433 | B2 * | 2/2003 | Loose et al. | 463/20 |
| 6,569,018 | B2 * | 5/2003 | Jaffe | 463/30 |
| 6,887,157 | B2 * | 5/2005 | LeMay et al. | 463/32 |
| 2003/0087690 | A1 | 5/2003 | Loose et al. | |

FOREIGN PATENT DOCUMENTS

| | | | |
|---|---|---|---|
| DE | 4436171 | A1 | 4/1996 |
| GB | 2 274 010 | A | 7/1994 |
| GB | 2274010 | A | 7/1994 |
| GB | 2274010 | A * | 7/1994 |
| GB | 2 294 571 | A | 5/1996 |
| JP | 64-54476 | U | 4/1989 |
| JP | 04-220276 | A1 | 8/1992 |
| JP | 2000-350805 | A1 | 12/2000 |
| JP | 2001-161892 | A | 6/2001 |
| JP | 2002-102449 | A | 4/2002 |
| JP | 3086683 | U | 4/2002 |

OTHER PUBLICATIONS

European Search Report Dated Aug. 20, 2004.
JPO Office Action with translation, #553409, Dec. 5, 2006 (4 pages).
First Notification of Office Action from State Intellectual Property Office of China dated Jun. 22, 2007 for Application No. 200410006867.4.

* cited by examiner

*Primary Examiner*—Robert E. Pezzuto
*Assistant Examiner*—Omkar Deodhar
(74) *Attorney, Agent, or Firm*—Rader, Fishman & Grauer, PLLC

(57) ABSTRACT

A gaming machine includes: a variable display means for producing variable display of a plurality of symbols; a front display means being provided in front of the variable display means for enabling a player to see symbols on the variable display means through the front display means, the front display means being capable of displaying various images; and a display scaling means for making it possible to scale up or down display on the front display means and/or the variable display means.

18 Claims, 43 Drawing Sheets

FIG. 5

| | LEFT REEL | | CENTER REEL | | RIGHT REEL |
|---|---|---|---|---|---|
| 00 | RED 7 | 00 | RED 7 | 00 | RED 7 |
| 01 | CHERRY | 01 | PLUM | 01 | BELL |
| 02 | BLUE 7 | 02 | REPLAY | 02 | REPLAY |
| 03 | BELL | 03 | BELL | 03 | BAR |
| 04 | REPLAY | 04 | CHERRY | 04 | PLUM |
| 05 | RED 7 | 05 | REPLAY | 05 | BELL |
| 06 | CHERRY | 06 | CHERRY | 06 | REPLAY |
| 07 | BLUE 7 | 07 | BELL | 07 | CHERRY |
| 08 | BELL | 08 | BAR | 08 | BLUE 7 |
| 09 | REPLAY | 09 | CHERRY | 09 | CHERRY |
| 10 | PLUM | 10 | REPLAY | 10 | BELL |
| 11 | BELL | 11 | BELL | 11 | REPLAY |
| 12 | REPLAY | 12 | BLUE 7 | 12 | CHERRY |
| 13 | BAR | 13 | REPLAY | 13 | PLUM |
| 14 | RED 7 | 14 | CHERRY | 14 | BELL |
| 15 | BELL | 15 | BELL | 15 | REPLAY |
| 16 | PLUM | 16 | BAR | 16 | CHERRY |
| 17 | REPLAY | 17 | PLUM | 17 | BLUE 7 |
| 18 | PLUM | 18 | REPLAY | 18 | BELL |
| 19 | BELL | 19 | BELL | 19 | REPLAY |
| 20 | REPLAY | 20 | CHERRY | 20 | CHERRY |

FIG. 6

PRIZES AND NUMBERS OF PAID-OUT MEDALS CORRESPONDING TO WINNING SYMBOL COMBINATIONS IN EACH GAMING STATE

| SYMBOL COMBINATION | ORDINARY GAMING STATE | ORDINARY GAMING STATE IN BB | RB GAMING STATE |
|---|---|---|---|
| RED 7-RED 7-RED 7 | BB, 15 MEDALS | — | — |
| BLUE 7-BLUE 7-BLUE 7 | BB, 15 MEDALS | — | — |
| BAR-BAR-BAR | RB, 15 MEDALS | — | — |
| BELL-BELL-BELL | SMALL PRIZE OF BELL, 15 MEDALS | SMALL PRIZE OF BELL, 15 MEDALS | — |
| PLUM-PLUM-PLUM | SMALL PRIZE OF PLUM, SIX MEDALS | SMALL PRIZE OF PLUM, SIX MEDALS | — |
| REPLAY-REPLAY-REPLAY | REPLAY, 0 MEDAL | RB (JAC IN), 15 MEDALS | PRIZE, 15 MEDALS |
| CHERRY-ANY-ANY | SMALL PRIZE OF CHERRY, TWO OR FOUR MEDALS | SMALL PRIZE OF CHERRY, TWO OR FOUR MEDALS | — |

IMAGE FOR NOTIFYING PLAYER THAT PLAYER IS TO OPERATE LEFT STOP BUTTON

IMAGE FOR NOTIFYING PLAYER THAT PLAYER IS TO OPERATE RIGHT STOP BUTTON

IMAGE FOR NOTIFYING PLAYER THAT PLAYER IS TO OPERATE CENTER STOP BUTTON

FIG. 9A

PROBABILITY LOTTERY TABLE USED IN ORDINARY GAMING STATE
(RANDOM NUMBER EXTRACTION RANGE: 0—16383)

| WINNING COMBINATION | ACCEPTED RANDOM NUMBER RANGE BET COUNT=3 | INTERNAL WINNING ODDS |
|---|---|---|
| BB | 0 TO 54 | 55/16384 |
| RB | 55 TO 82 | 28/16384 |
| REPLY | 83 TO 2327 | 2245/16384 |
| SMALL PRIZE OF BELL | 2328 TO 10919 | 8592/16384 |
| SMALL PRIZE OF PLUM | 10920 TO 10973 | 54/16384 |
| SMALL PRIZE OF CHERRY | 10974 TO 11036 | 63/16384 |

FIG. 9B

PROBABILITY LOTTERY TABLE USED IN ORDINARY GAMING STATE IN BB
(RANDOM NUMBER EXTRACTION RANGE: 0—16383)

| WINNING COMBINATION | ACCEPTED RANDOM NUMBER RANGE BET COUNT=3 | INTERNAL WINNING ODDS |
|---|---|---|
| BB | — TO — | 0/16384 |
| RB | — TO — | 0/16384 |
| REPLY (RB IN BB) | 0 TO 4199 | 4200/16384 |
| SMALL PRIZE OF BELL | 4200 TO 14499 | 10300/16384 |
| SMALL PRIZE OF PLUM | 14500 TO 16319 | 1820/16384 |
| SMALL PRIZE OF CHERRY | — TO — | 0/16384 |

FIG. 10

STOP CONTROL TABLE NUMBER SELECTION TABLE (RANDOM NUMBER EXTRACTION RANGE: 0—255)

| TABLE NO. | ACCEPTED RANDOM NUMBER RANGE BET COUNT=3 | SELECTION ODDS |
|---|---|---|
| NO.1 | 0 TO 42 | 43/256 |
| NO.2 | 43 TO 85 | 43/256 |
| NO.3 | 86 TO 128 | 43/256 |
| NO.4 | 129 TO 171 | 43/256 |
| NO.5 | 172 TO 213 | 42/256 |
| NO.6 | 214 TO 255 | 42/256 |

FIG. 11

RELATIONSHIP AMONG TABLE NUMBERS, STOP ORDERS, AND COMPLETION/INCOMPLETION OF WINNING GAME OF SMALL PRIZE OF BELL

| | | TABLE NUMBER | | | | | |
|---|---|---|---|---|---|---|---|
| | | 1 | 2 | 3 | 4 | 5 | 6 |
| STOP ORDER | LEFT CENTER RIGHT | COMPLETE | INCOMPLETE | INCOMPLETE | INCOMPLETE | INCOMPLETE | INCOMPLETE |
| | LEFT RIGHT CENTER | INCOMPLETE | COMPLETE | INCOMPLETE | INCOMPLETE | INCOMPLETE | INCOMPLETE |
| | CENTER LEFT RIGHT | INCOMPLETE | INCOMPLETE | COMPLETE | INCOMPLETE | INCOMPLETE | INCOMPLETE |
| | CENTER RIGHT LEFT | INCOMPLETE | INCOMPLETE | INCOMPLETE | COMPLETE | INCOMPLETE | INCOMPLETE |
| | RIGHT LEFT CENTER | INCOMPLETE | INCOMPLETE | INCOMPLETE | INCOMPLETE | COMPLETE | INCOMPLETE |
| | RIGHT CENTER LEFT | INCOMPLETE | INCOMPLETE | INCOMPLETE | INCOMPLETE | INCOMPLETE | COMPLETE |

FIG. 12

WINNING STOP CONTROL TABLE
(INTERNAL WINNING COMBINATION: SMALL PRIZE OF BELL)

| LEFT REEL | | CENTER REEL | | RIGHT REEL | |
|---|---|---|---|---|---|
| STOP OPERATION POSITION | STOP CONTROL POSITION | STOP OPERATION POSITION | STOP CONTROL POSITION | STOP OPERATION POSITION | STOP CONTROL POSITION |
| 00 | 19 | 00 | 19 | 00 | 18 |
| 01 | 19 | 01 | 19 | 01 | 01 |
| 02 | 19 | 02 | 19 | 02 | 01 |
| 03 | 03 | 03 | 03 | 03 | 01 |
| 04 | 03 | 04 | 03 | 04 | 01 |
| 05 | 03 | 05 | 03 | 05 | 05 |
| 06 | 03 | 06 | 03 | 06 | 05 |
| 07 | 03 | 07 | 07 | 07 | 05 |
| 08 | 08 | 08 | 07 | 08 | 05 |
| 09 | 08 | 09 | 07 | 09 | 05 |
| 10 | 08 | 10 | 07 | 10 | 10 |
| 11 | 11 | 11 | 11 | 11 | 10 |
| 12 | 11 | 12 | 11 | 12 | 10 |
| 13 | 11 | 13 | 11 | 13 | 10 |
| 14 | 11 | 14 | 11 | 14 | 14 |
| 15 | 15 | 15 | 15 | 15 | 14 |
| 16 | 15 | 16 | 15 | 16 | 14 |
| 17 | 15 | 17 | 15 | 17 | 14 |
| 18 | 15 | 18 | 15 | 18 | 18 |
| 19 | 19 | 19 | 19 | 19 | 18 |
| 20 | 19 | 20 | 19 | 20 | 18 |

FIG. 13

FORWARD PUSH, CENTER PUSH LOSING STOP CONTROL TABLE
(INTERNAL WINNING COMBINATION: SMALL PRIZE OF BELL)

| LEFT REEL | | CENTER REEL | | RIGHT REEL | |
|---|---|---|---|---|---|
| STOP OPERATION POSITION | STOP CONTROL POSITION | STOP OPERATION POSITION | STOP CONTROL POSITION | STOP OPERATION POSITION | STOP CONTROL POSITION |
| 00 | 19 | 00 | 19 | 00 | 19 |
| 01 | 19 | 01 | 19 | 01 | 19 |
| 02 | 19 | 02 | 19 | 02 | 02 |
| 03 | 03 | 03 | 03 | 03 | 02 |
| 04 | 03 | 04 | 03 | 04 | 02 |
| 05 | 03 | 05 | 03 | 05 | 02 |
| 06 | 03 | 06 | 03 | 06 | 06 |
| 07 | 03 | 07 | 07 | 07 | 06 |
| 08 | 08 | 08 | 07 | 08 | 06 |
| 09 | 08 | 09 | 07 | 09 | 06 |
| 10 | 08 | 10 | 07 | 10 | 06 |
| 11 | 11 | 11 | 11 | 11 | 11 |
| 12 | 11 | 12 | 11 | 12 | 11 |
| 13 | 11 | 13 | 11 | 13 | 11 |
| 14 | 11 | 14 | 11 | 14 | 11 |
| 15 | 15 | 15 | 15 | 15 | 15 |
| 16 | 15 | 16 | 15 | 16 | 15 |
| 17 | 15 | 17 | 15 | 17 | 15 |
| 18 | 15 | 18 | 15 | 18 | 15 |
| 19 | 19 | 19 | 19 | 19 | 19 |
| 20 | 19 | 20 | 19 | 20 | 19 |

FIG. 14

REVERSE PUSH LOSING STOP CONTROL TABLE
(INTERNAL WINNING COMBINATION: SMALL PRIZE OF BELL)

| LEFT REEL | | CENTER REEL | | RIGHT REEL | |
|---|---|---|---|---|---|
| STOP OPERATION POSITION | STOP CONTROL POSITION | STOP OPERATION POSITION | STOP CONTROL POSITION | STOP OPERATION POSITION | STOP CONTROL POSITION |
| 00 | 20 | 00 | 19 | 00 | 18 |
| 01 | 20 | 01 | 19 | 01 | 01 |
| 02 | 20 | 02 | 19 | 02 | 01 |
| 03 | 20 | 03 | 03 | 03 | 01 |
| 04 | 04 | 04 | 03 | 04 | 01 |
| 05 | 04 | 05 | 03 | 05 | 05 |
| 06 | 04 | 06 | 03 | 06 | 05 |
| 07 | 04 | 07 | 07 | 07 | 05 |
| 08 | 04 | 08 | 07 | 08 | 05 |
| 09 | 09 | 09 | 07 | 09 | 05 |
| 10 | 09 | 10 | 07 | 10 | 10 |
| 11 | 09 | 11 | 11 | 11 | 10 |
| 12 | 12 | 12 | 11 | 12 | 10 |
| 13 | 12 | 13 | 11 | 13 | 10 |
| 14 | 12 | 14 | 11 | 14 | 14 |
| 15 | 12 | 15 | 15 | 15 | 14 |
| 16 | 12 | 16 | 15 | 16 | 14 |
| 17 | 17 | 17 | 15 | 17 | 14 |
| 18 | 17 | 18 | 15 | 18 | 18 |
| 19 | 17 | 19 | 19 | 19 | 18 |
| 20 | 20 | 20 | 19 | 20 | 18 |

FIG. 15A

CEILING-NUMBER-OF-AT-TIMES SELECTION TABLE

| NUMBER OF TIMES | LOTTERY VALUE |
|---|---|
| 1 | 2356 |
| 2 | 1512 |
| 5 | 196 |
| 10 | 28 |
| 30 | 4 |

FIG. 15B

AT ACTIVATION LOTTERY TABLE

| | LOTTERY VALUE |
|---|---|
| ACTIVATION | 32 |
| CONCEALMENT | 224 |

FIG. 16A

CEILING ACTIVATION VALUE SELECTION TABLE

| NUMBER OF MEDALS | LOTTERY VALUE |
|---|---|
| 1200 | 64 |
| 1500 | 128 |
| 1800 | 64 |

FIG. 16B

CEILING METER SHIFT SELECTION TABLE

| | | 1200 MEDALS | 1500 MEDALS | 1800 MEDALS |
|---|---|---|---|---|
| CEILING METER LEVEL | LEVEL 1 | 150 | 188 | 225 |
| | LEVEL 2 | 300 | 375 | 450 |
| | LEVEL 3 | 450 | 563 | 675 |
| | LEVEL 4 | 600 | 750 | 900 |
| | LEVEL 5 | 750 | 938 | 1125 |
| | LEVEL 6 | 900 | 1125 | 1350 |
| | LEVEL 7 | 1050 | 1313 | 1575 |
| | LEVEL 8 | 1200 | 1500 | 1800 |

FIG. 17

START COMMAND

| | |
|---|---|
| 1 | INTERNAL WINNING COMBINATION |
| 2 | BB |
| | RB |
| | REPLAY |
| | BELL |
| | PLUM |
| | CHERRY |
| | BLANK |
| | — |
| 3 | GAMING STATE |
| 4 | DURING ORDINARY GAME |
| | DURING INTERNAL WINNING OF BB |
| | DURING INTERNAL WINNING OF RB |
| | DURING BB OPERATION |
| | DURING RB OPERATION |
| | — |
| | — |
| | — |
| 5 | STOP CONTROL TABLE |
| 6 | TABLE NO.1 |
| | TABLE NO.2 |
| | TABLE NO.3 |
| | TABLE NO.4 |
| | TABLE NO.5 |
| | TABLE NO.6 |
| | — |
| | — |

BB EXIT COMMAND

| | |
|---|---|
| 1 | OPERATION AT BB EXIT TIME |
| 2 | GAME REPLAY ENABLE |
| | ADJUSTMENT OPERATION |
| | PLAY OUT OPERATION |
| | — |
| | — |
| | — |
| | — |
| | — |

FIG. 18

WINNING GAME COMMAND

| | |
|---|---|
| 1 | WINNING GAME |
| 2 | BB |
| | RB |
| | REPLAY |
| | BELL |
| | PLUM |
| | CHERRY |
| | BLANK |
| | — |
| 3 | GAMING STATE |
| 4 | DURING ORDINARY GAME |
| | DURING INTERNAL WINNING OF BB |
| | DURING INTERNAL WINNING OF RB |
| | DURING BB OPERATION |
| | DURING RB OPERATION |
| | — |
| | — |
| | — |
| 5 | WINNING GAME LINE |
| 6 | CENTER STAGE |
| | UPPER STAGE |
| | LOWER STAGE |
| | RISE TO RIGHT |
| | FALL TO RIGHT |
| | — |
| | — |
| | — |

GAME PLAY MEDAL INPUT COMMAND

| | |
|---|---|
| 1 | NUMBER OF INPUT MEDALS |
| 2 | ONE |
| | TWO |
| | THREE |
| | — |
| | — |
| | — |
| | — |
| | — |

GAMING MACHINE

BACKGROUND OF THE INVENTION

1. Field of the Invention

The present invention relates to a gaming machine such as a slot machine or a Japanese pinball machine (a so-called "pachinko machine", which will be simply referred to as "pinball machine") including a variable display means for variably displaying various symbols provided for playing a game and a control means such as a microcomputer for controlling the various display.

2. Description of the Related Art

Hitherto, as a conventional gaming machine of the above described type, for example, a slot machine including stopping means has been known (a so-called "pinball slot machine" or a so-called "Pachi-Slot machine" in Japan). FIG. 43 shows a conventional pinball slot machine X.

The pinball slot machine X has a variable display means having the configuration wherein three rotation reels 104 to 106 for displaying various display of a plurality of symbols are disposed in display windows 101 to 103 provided in a front panel 100 and reel stop buttons 107 to 109 for stopping the rotation reels 104 to 106 are provided. When a predetermined symbol combination becomes complete through the variable display means, the player gains a prize.

Printed on the front of the front panel 100 are a one-medal pay line 111 at the middle stage which becomes activated with insertion of one medal, two two-medal pay lines 112*a* an 112*b* which become activated with insertion of two medals, and two three-medal pay lines 113*a* an 113*b* which become activated with insertion of three medals for nine symbols (three columns×three rows) displayed through the display windows 101 to 103. In the Figure, numeral 114 denotes a game medium (such as medal, coin, or the like) slot and numeral 115 denotes a start lever for starting a game. In addition to the above-described variable display means having the mechanical configuration using the rotation reels 104 to 106, a variable display means having a display screen such as a liquid crystal screen, on which various display of symbols can be produced is also available.

As a gaming manner, a game is started as the player inserts game medium into the game medium slot 114. As the player handles the start lever 115, control means controls the variable display means for rotating the reels 104 to 106, thereby producing various display of symbols.

For the symbols variable displayed, the rotating reels 104 to 106 are stopped in order automatically in a given time or as the player operates the reel stop buttons 107 to 109. At this time, if the symbols on the reels 104 to 106 appearing in the display windows 101 to 103 become a specific combination (winning symbol combination), game medium are paid out to the player as the prize of the win.

The pinball slot machine X has different winning states. Particularly, in some pinball slot machines, when the winning game of a predetermined winning combination is completed, the player is placed in a gaming state in which the player is given a better condition than the usual state for a predetermined time period in addition to paying out a predetermined number of medals. Such winning combinations include a winning combination for allowing the player to play a predetermined number of games giving a relatively large prize to the player, which will be hereinafter referred to as big bonus (BB), and a winning combination for allowing the player to play a predetermined number of games giving a relatively small prize to the player, which will be hereinafter referred to as regular bonus (RB).

In the pinball slot machine X, internal lottery processing (simply, internal lottery) is performed and the symbol combination stopped and displayed along the line of the pay lines 111 to 113 made activated, which will be hereinafter referred to as activated line, is determined based on the lottery result and a stop operation timing of the reel stop buttons 107 to 109 pressed by the player. That is, to complete a winning game for paying out medals or coins to the player, it is required that the winning combination be won according to the internal lottery processing, which will be hereinafter referred to as internal winning, and that the player perform stop operation at the timing at which the symbol combination indicating completion of the winging game of the winning combination gaining the internal winning, which will be hereinafter referred to as internal winning combination, can be stopped on the activated line.

That is, even if the internal winning is accepted, if the player cannot perform the stop operation at a good timing, the player cannot complete the winning game. Thus, the gaming machines requiring that the player have a technique for performing the stop operation at the good timing (the relative importance of intervention of the technique called "observation push" is high) are mainstream at present.

In such gaming machines, recently, various techniques for designing the front panel 100 and displaying the pay lines 111 to 113 and symbols have been proposed to enhance the game amusement and easily determine a winning game.

For example, in a gaming machine described in JP-A-4-220276, three sets of liquid crystal shutters are placed in rows in front of display windows corresponding to three rotation reels and when each game is over, the symbols corresponding to the winning symbol combination are displayed through the display window; on the other hand, the liquid crystal shutters corresponding to the remaining six symbols which are not the winning symbol combination are switched to opacity, so that only the three winning game symbols corresponding to the winning symbol combination on the pay line are displayed on the symbol display window.

In a gaming machine described in JP-A-2000-350805, an optically transparent information display panel including a matrix display unit that can display a dot pattern with a plurality of rows and a plurality of columns of dots is provided at the rear of a front panel or in the proximity of the rear of the front panel and moreover the information display panel is implemented as a transparent EL (electro-luminescent) panel for displaying optically transparent characters and symbols in dot patterns.

SUMMARY OF THE INVENTION

In the above-described gaming machine including the liquid crystal shutters (JP-A-4-220276), the symbols which do not correspond to the winning game are hidden and the symbols corresponding to the winning game combination can be clearly displayed, however, other lines than the activated line are also displayed and a large number of lines are always displayed. Thus, the symbols on the reels become hard to see and various indicator lamps and indicators need to be added, resulting a problem that the structure of the gaming machine becomes complicated.

In the gaming machine including the information display panel (JP-A-2000-350805), it is possible only to display the activated line and to extensively display an effect image. However, because of the optically transparent panel, the symbols on the reels are always seen through the dot patterns and an effect image is always transparent-displayed and it is feared that the effect image may overlap the symbols on the reels, making them hard to see.

Moreover, the related techniques described above are the technique for switching the liquid crystal shutters to opacity for enhancing the visibility of the necessary symbols on the reels and the technique using the optically transparent information display panel for the player to see any other information image while seeing through the symbols on the reels; the related techniques lack the technical philosophy of displaying a necessary image more sharply and impactfully and do not make a strong appeal of amusement of playing a game to the player.

It is therefore an object of the invention to provide a gaming machine for scaling up or down display of symbols on reels and an effect image displayed with the symbols seen through the image for more enhancing amusement of the game.

According to the invention, there is provided a gaming machine including: variable display means for variably displaying a plurality of symbols; front display means provided in front of the variable display means and configured to enable a player to see at least one of the symbols on the variable display means therethrough, and to display various images; internal winning combination determination means configured to determine an internal winning combination; a plurality of operation means with which the player stops the variable display of the variable display means based on the determination result of the internal winning combination determination means and on a stop operation of each of the operation means; game medium payout means configured to pay out a game medium to the player in a case where a stop state of the variable display means stopped by the stop control means corresponds to a predetermined stop state; and display scaling means configured to scale up or down at least one of the symbols and various images displayed on the front display means and/or the variable display means.

The display scaling means may include a convex lens or a Fresnel lens.

Further, the distance between the display scaling means and the front display means may be made relatively variable.

BRIEF DESCRIPTION OF THE DRAWINGS

In the accompanying drawings:

FIG. 5 is a drawing to show symbol rows arranged on reels;

FIG. 6 is a drawing to show winning combinations and numbers of paid-out medals corresponding to winning symbol combinations;

FIGS. 9A and 9B are drawings to show probability lottery tables;

FIG. 10 is a drawing to show a stop control table number section table;

FIG. 11 is a drawing to show the relationship between the stop button push order and completion/incompletion of winning game for each stop table number;

FIG. 12 is a drawing to show an example of a stop control table;

FIG. 13 is a drawing to show an example of a stop control table;

FIG. 14 is a drawing to show an example of a stop control table;

FIG. 15A is a drawing to show a ceiling-number-of-AT-times selection table and FIG. 15B is a drawing to show an AT activation lottery table;

FIG. 16A is a drawing to show a ceiling activation value selection table and FIG. 16B is a drawing to show a ceiling meter shift selection table;

FIG. 17 is a drawing to show examples of commands transmitted from a main control circuit to the sub-control circuit;

FIG. 18 is a drawing to show examples of commands transmitted from the main control circuit to the sub-control circuit;

DETAILED DESCRIPTION OF THE PREFERRED EMBODIMENTS

Figure 1:
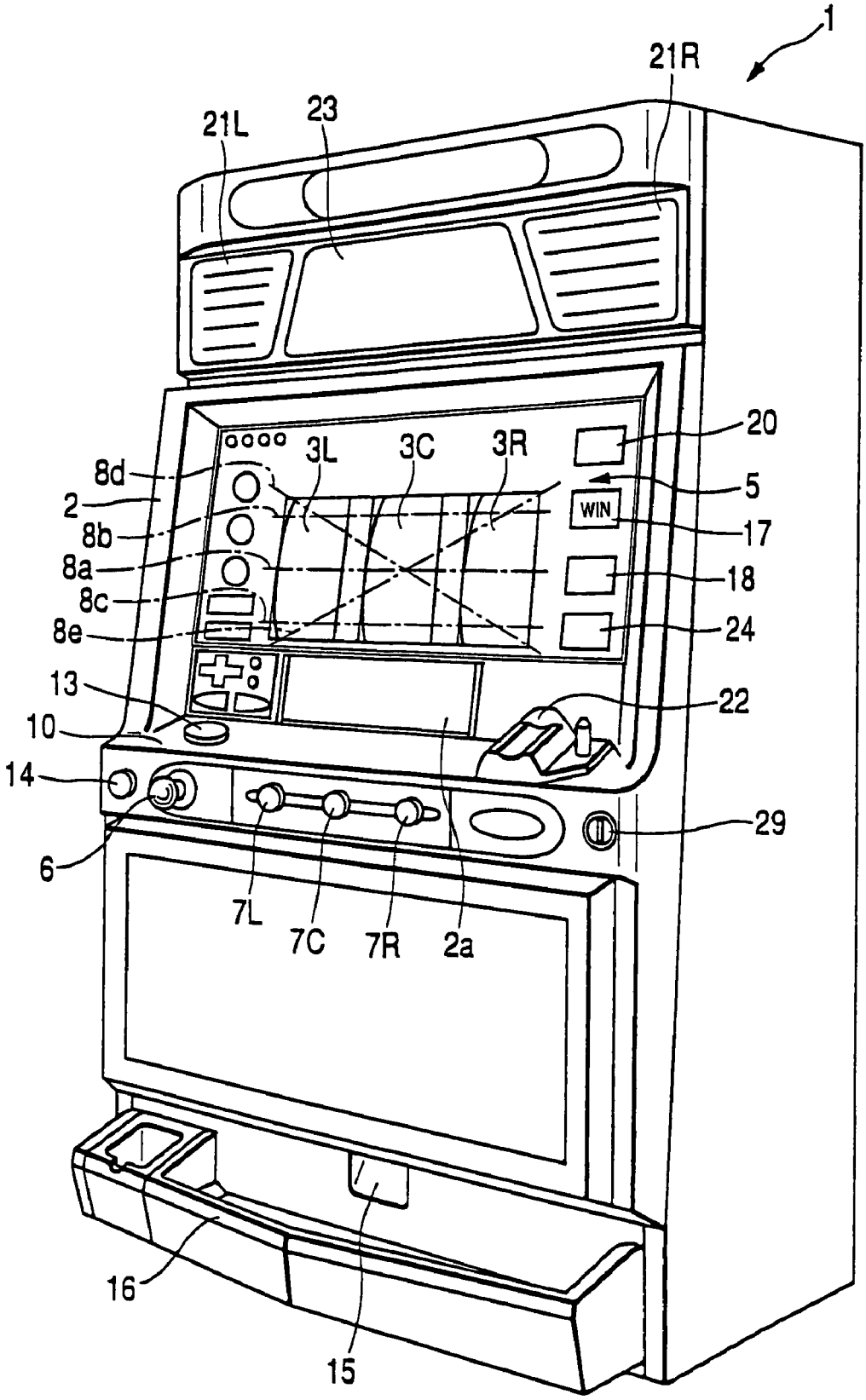
FIG. 1 is a perspective view of a slot machine according to an embodiment of the invention.

A gaming machine of the invention includes: a variable display unit that is configured to produce variable display of a plurality of symbols; a front display unit that is provided in front of the variable display unit and configured to enable a player to see symbols on the variable display unit therethrough, and to display various images; an internal winning combination determination unit that is configured to determine an internal winning combination; a plurality of operation units with which the player inserts a stop operation of the variable display; a stop control unit that is configured to perform a stop control of the variable display of the variable display unit based on the determination result of the internal winning combination determination unit and the stop operation inserted to the operation unit; a game medium payout unit that is configured to pay out game medium to the player in a case where a stop state of the variable display unit stopped by the stop control unit corresponds to a predetermined stop state; and a display scaling unit that is configured to scale up or down the display displayed on the front display unit and/or the variable display unit.

That is, the gaming machine includes the variable display unit having a plurality of rotation reels with symbols drawn thereon and the front display unit made up of a panel display, being provided in front of the variable display unit for enabling the player to see the symbols through the front display unit and making it possible to produce some information display containing images and alternative lamps in various images and moreover includes the display scaling unit for making it possible to scale up or down display on the front display unit and the symbols on the rotation reels seen through the front display unit.

As display of the necessary image is thus scaled up or down, a stronger impact is given to the player; and as an effect image is scaled up, sharper display is produced, so that amusement of the gaming machine for the player to enjoy the effect image is still more enhanced and it is made possible for the player to be satisfied with playing a game without getting tired of the game.

As the display scaling means, a convex lens or a Fresnel lens can be provided and it is made possible to scale up or down display according to a simple configuration.

In the above configuration, the distance between the display scaling unit and the front display unit is made preferably to be variable, and an appropriate move mechanism for this purpose is provided. For example, to move the display scaling unit, a motor and the like may be used as the drive source for moving the display scaling unit and the display scaling unit may be moved in the back and forth direction through an actuator drivingly associated with the motor.

Alternatively, it is also possible to configure the display scaling unit so as to form in a proper size to be usually stored in a hidden position and to be moved in parallel with a panel of display unit as required for scaling up or down any desired part in a spot-like manner.

A liquid crystal panel or an EL (electro-luminescence) panel can be preferably used as the panel display of the display unit and the following structure can be adopted.

For example, assuming that the liquid crystal panels are used as the panel display, the liquid crystal panels are disposed as two layers and the liquid crystal panel placed on the rotation reel side is formed with a cut-off portion through which the symbols on the rotation reels can be exposed.

According to the configuration, the player can see the symbols on the rotation reels through one liquid crystal panel and thus if the two liquid crystal panels are used to display an image, the symbols on the rotation reels are always displayed comparatively sharply.

A shape of a hole and a size of a cut-off portion may be configured appropriately. For example, one hole shaped like a large rectangle through which the whole of three rotation reels can be seen may be adopted or three slip-shaped holes may be provided with a one-to-one correspondence with the three rotation reels. Alternatively, three symbols can be seen on one rotation reel, generally, and thus nine comparatively small rectangular holes to such an extent that each symbol can be seen therethrough may be adopted.

A gaming machine according to an embodiment of the invention will be discussed more specifically with reference to the accompanying drawings.

Figure 2:
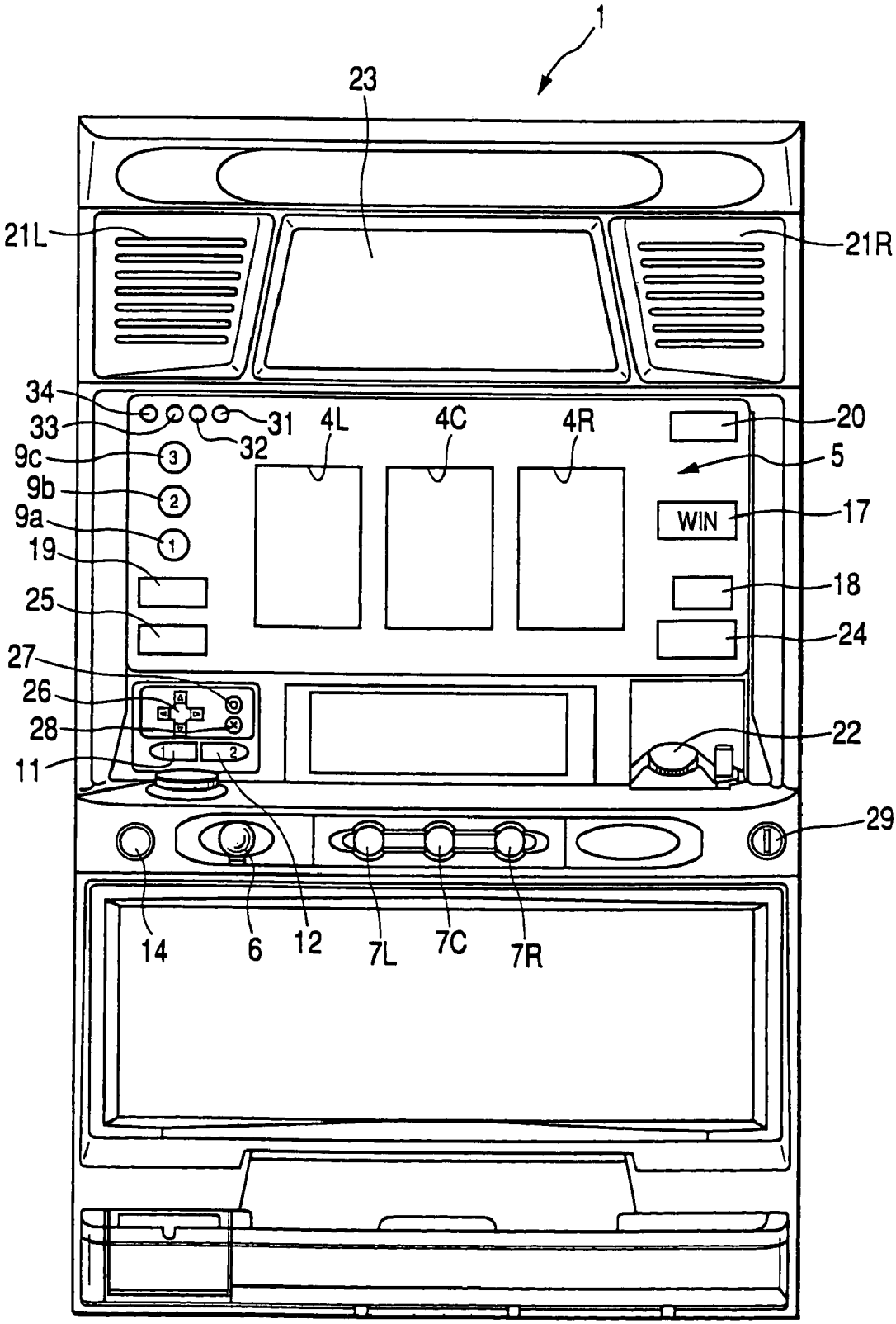
FIG. 2 is a front view of the slot machine according to the embodiment of the invention.

FIG. 1 is a perspective view to show the appearance of a gaming machine 1 of a first embodiment according to the invention. FIG. 2 is a front view of the gaming machine 1 of a first embodiment according to the invention.

The gaming machine 1 is a so-called "pinball slot machine" (Pachi-Slot machine) including three rotation reels for producing various display of symbols and allows the player to play a game using game medium such as a card storing information of the game play value given to the player as well as coins, medals, and tokens. In the following description, it is assumed that the player uses medals.

A panel display unit 5 implemented as a liquid crystal display as front display means is provided at the front of a cabinet 2 forming the whole of the gaming machine 1.

In the cabinet 2, three rotation reels 3L, 3C, and 3R each with a symbol row made up of different types of symbols drawn on the outer peripheral surface are provided in a row for rotation for providing variable display means. The player can observe the symbols on the reels through display windows 4L, 4C, and 4R seen through the panel display unit 5. Each reel rotates at a constant speed (for example, 80 revolutions per minute).

Although the internal configuration of the panel display unit 5 forming the main part of the invention is described later in detail, the panel display unit 5 is provided fully with a screen 5*a* through which the rotation reels 3L, 3C, and 3R can be seen, as shown in the Figure. When viewed from the player, the following components appear.

The vertically oriented rectangular display windows 4L, 4C, and 4R are seen at the center of the display screen 5*a*, and a center line 8*a*, a top line 8*b*, and a bottom line 8*c* in the horizontal direction and a cross down line 8*d* and cross up line 8*e* in the slanting directions as pay lines are visible in the display windows 4L, 4C, and 4R. As the pay lines, one, three, or five lines are made activated as the player operates a 1-BET switch 11, a 2-BET switch 12, or a MAX-BET switch 13, which will be described later, or inserts medals into a medal insertion slot 22. Which pay lines are made activated is indicated as the corresponding lines are lighted and a BET lamp 9*a*, 9*b*, or 9*c*, which will be described below, is lighted.

That is, the 1-BET lamp 9*a*, the 2-BET lamp 9*b*, the MAX-BET lamp 9*c*, and a deposited-number-of-game-medals display unit 19 are provided on the left of the display windows 4L, 4C, and 4R. The 1-BET lamp 9*a*, the 2-BET lamp 9*b*, or the MAX-BET lamp 9*c* is lighted in response to the number of medals bet to play one game, which will be hereinafter referred to as the BET count. In the embodiment, one game is over when all reels stop or when game medium have been paid out if game medium are paid out. When the BET count is 1 and one pay line is made activated, the 1-BET lamp 9*a* is lighted; when the BET count is 2 and three pay lines are made activated, the 2-BET lamp 9*b* is lighted; and when the BET count is 3 and all the five pay lines are made activated, the MAX-BET lamp 9*c* is lighted. A game play start indicator lamp 25 provided below the BET lamps 9*a*, 9*b*, and 9*c* is lighted when at least one pay line is made activated. Further, the deposited-number-of-game-medals display unit 19 displays the deposited number of medals.

A WIN lamp 17, a payout display unit 18, and a game play medal insertion lamp 24 are provided on the right of the display windows 4L, 4C, and 4R. The WIN lamp 17 is lighted at a predetermined probability when the internal winning is accepted as BB or RB. The WIN lamp 17 is also lighted when the winning game of BB or RB is complete. The payout display unit 18 is made up of seven-segment LEDs for displaying the number of medals paid out when the winning game is complete. The game play medal insertion lamp 24 is blinked when insertion of game play medals can be accepted.

A number-of-bonus-game-operation-times display unit 20 is provided in the upper right corner of the display screen 5*a*. The number-of-bonus-game-operation-times display unit 20 displays the number of RB games that can be played, the possible number of winning games of RB (described later).

A game play stop indicator 31, a replay indicator 32, an RB operation indicator 33, and a BB operation indicator 34 are provided in a row in the upper left corner of the display screen 5*a*. The game play stop indicator 31 is lighted when the time interval between the preceding drum rotation and the current drum rotation is less than a predetermined time (in the embodiment, 4.1 seconds). The replay indicator 32 is lighted when replay is operated. The RB operation indicator 33 is lighted during the RB operation. The BB operation indicator 34 is lighted during the BB operation.

The display screen 5*a* also displays the "stop order" required for realizing completion of the winning game when the internal winning of "small prize of bell" is accepted in "stop operation assistance time period" (described later).

A frontward projection portion 10 of a horizontal plane is formed below the display windows 4L, 4C, and 4R seen through the display screen 5*a*, and an indication section 2*a* for indicating information concerning the gaming machine 1 is provided between the frontward projection portion 10 and the display windows 4L, 4C, and 4R.

A medal insertion slot 22 is provided on the right of the indication section 2*a*, and the 1-BET switch 11, the 2-BET switch 12, and the MAX-BET switch 13 are provided at the lower position to the left of the indication section 2*a*. A cross button 26, a "O" button 27, and a "X" button 28 are provided at the upper position to the left of the indication section 2*a*.

The 1-BET switch 11 enables the player to bet one of the credited medals by one push operation on a game. The 2-BET switch 12 enables the player to bet two of the credited medals by one push operation on a game. The MAX-BET switch 13 enables the player to bet as many medals as the maximum number of medals that can be bet on a game by one push operation. As the player operates any of the BET switches, the corresponding pay lines are made activated as described above.

The player can switch the display screen 5*a* and make entry by operating the cross button 26, the "O" button 27, and the "X" button 28.

A deposited medal adjusting switch 14 for the player to switch between credit and payout of the medals obtained by playing games by pushbutton operation is provided on the left of the front of the frontward projection portion 10. As the deposited medal adjusting switch 14 is switched, medals are paid out from a game play medal payout opening 15 in a lower part of the front and are stored in a game play medal tray 16. On the right of the deposited medal adjusting switch 14, a start lever 6 for rotating the reels for starting various display of symbols in the display windows 4L, 4C, and 4R (starting a game) as the player operates the start lever 6 is attached so that it can be turned in a predetermined angle range.

A door opening/closing and closing release device 29 is provided to the right of the front of the frontward projection portion 10. As the door opening/closing and closing release device 29 is turned to the right with a predetermined key, the front door is opened/closed; as the device 29 is turned to the left, closing is released.

Speakers 21L and 21R are provided on the upper left and right of the cabinet 2, and a payout table panel 23 for displaying winning symbol combination and the number of paid-out medals is provided between the two speakers 21L and 21R. Three stop buttons 7L, 7C, and 7R for stopping rotation of the three rotation reels 3L, 3C, and 3R are provided at the center of the front of the frontward projection portion 10 and below the indication section 2*a*.

The invention is characterized by the fact that the described gaming machine 1 includes display scaling unit for making it possible to scale up and down display on the front display unit and/or the variable display unit.

Referring to FIGS. 35 through 39, the display scaling unit of the main part of the invention will be discussed in detail while the configuration of the panel display unit 5 will be described. In the description that follows, a flat panel display is a two-layer liquid crystal panel having liquid crystal panels 501 and 502, and the second liquid crystal panel 502 placed on the side of the rotation reels 3L, 3C, and 3R is formed with a cut-off portion through which the symbols on the rotation reels 3L, 3C, and 3R can be exposed. According to the configuration, the player can see the symbols on the rotation reels 3L, 3C, and 3R through the first liquid crystal panel 501. As a result, even in a case where the two liquid crystal panels 501 and 502 are used to display an image, the symbols on the rotation reels 3L, 3C, and 3R are always displayed comparatively sharply.

Figure 35:
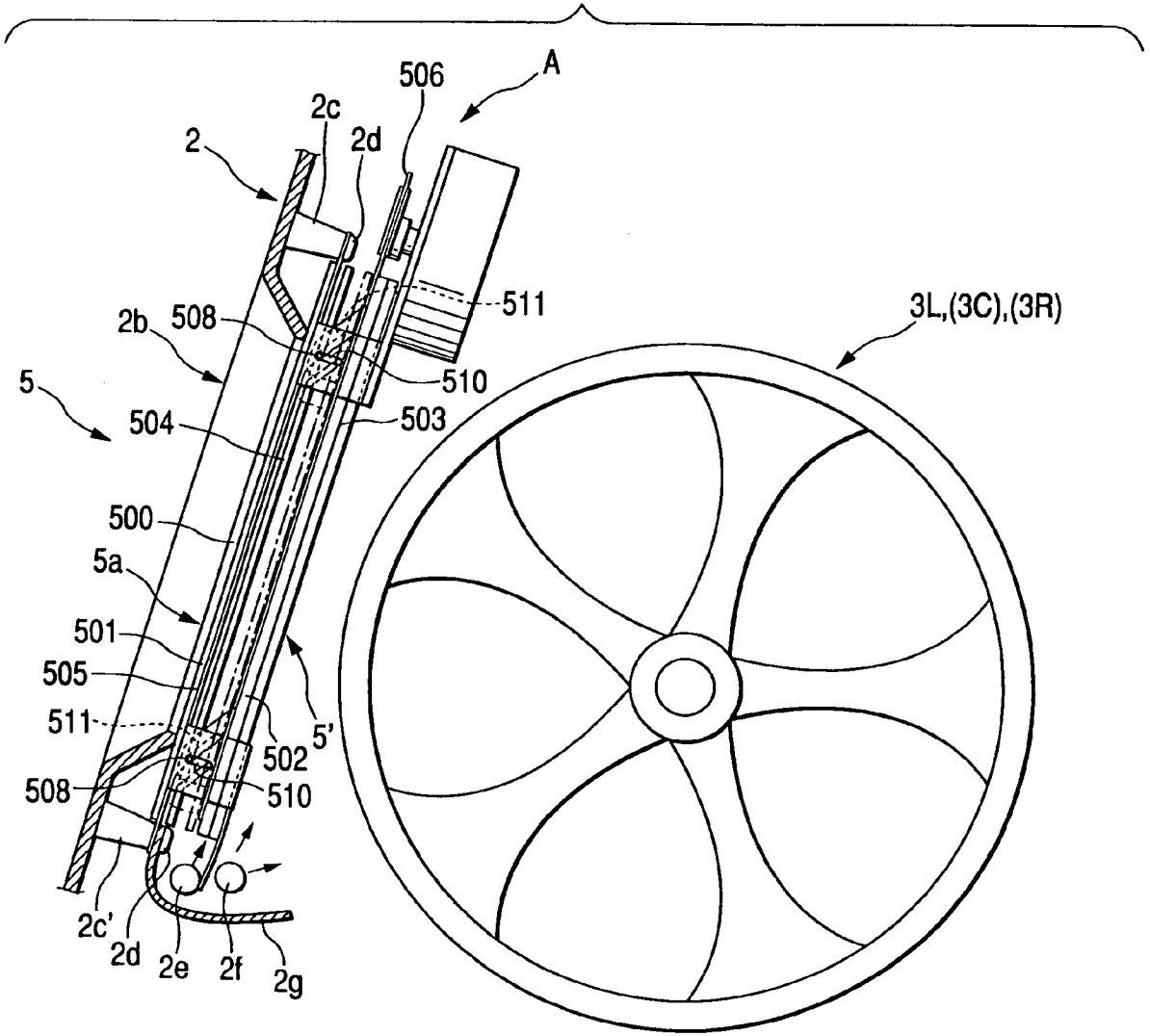
FIG. 35 is a schematic representation of a panel display unit.
Figure 36:
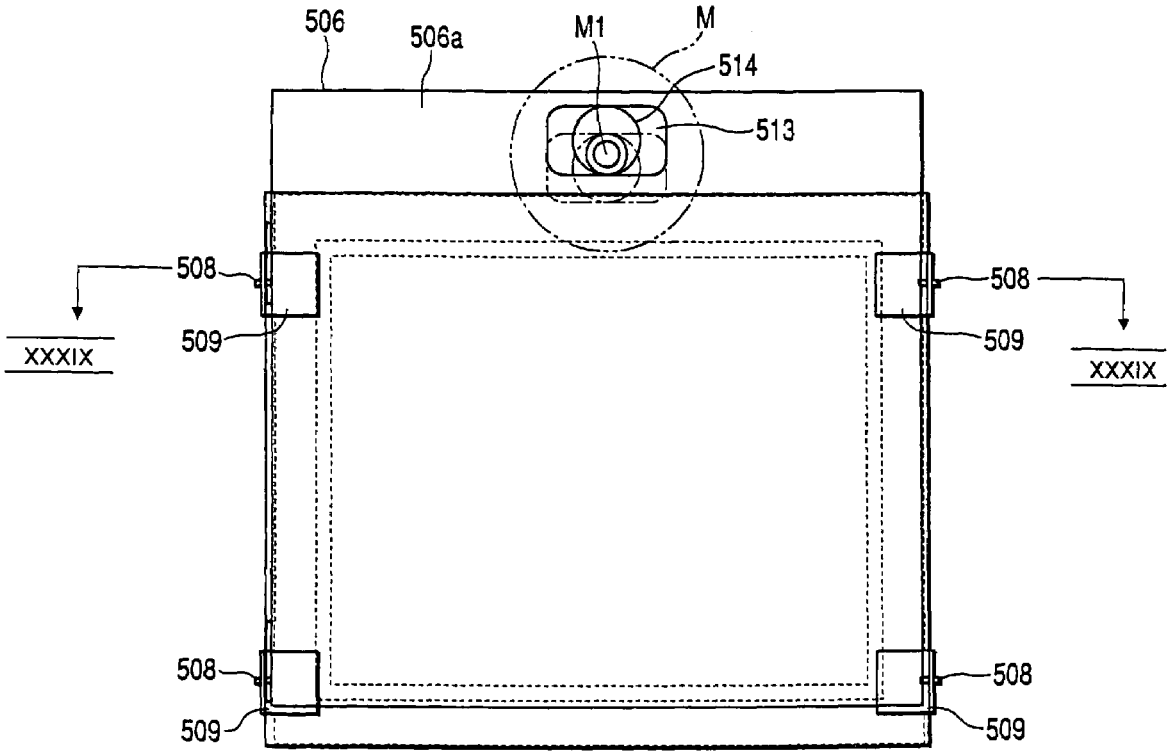
FIG. 36 is a rear view of the panel display unit.
Figure 37:
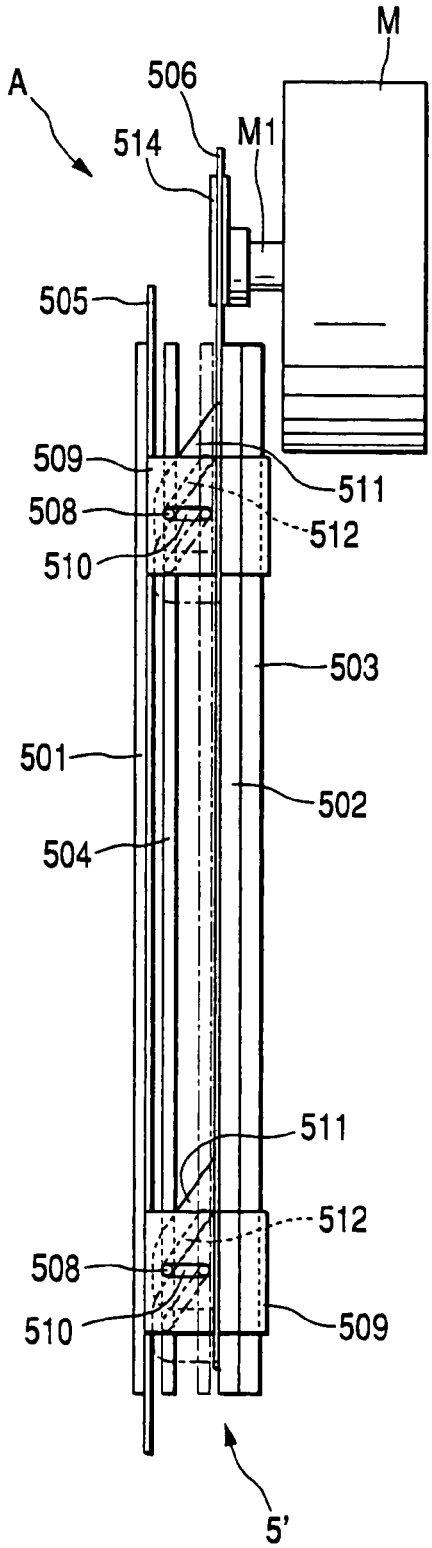
FIG. 37 is a side view of the panel display unit.

As shown in FIG. 35, the panel display unit 5 according to the embodiment has a multi-layer structure implemented as a multi-layer panel body 5' including, from the outermost side (front), transparent protective glass 500, the first and second liquid crystal panels 501 and 502 substantially constituting the front display unit and an acrylic plate 503 having a predetermined thickness forming a part of a backlight structure. Moreover, a Fresnel lens 504 that can be moved back and forth by a scaling mechanism section A is disposed between the first and second liquid crystal panels 501 and 502. In the embodiment, the scaling mechanism section A and the Fresnel lens 504 substantially make up display scaling means. A transparent acrylic plate may be used in place of the protective glass 500.

The multi-layer panel body 5' is attached to a front opening 2*b* of the cabinet 2 so as to face from the back of the front opening 2*b*, and the portion exposed from the cabinet 2 forms the display screen 5*a*. Numerals 2*c* and 2*c'* denote upper and lower panel mounting bosses and numeral 2*d* denotes a panel mounting screw.

A cold-cathode tube 2*e* for functioning as a backlight of the first and second liquid crystal panels 501 and 502 and a cold-cathode tube 2*f* capable of applying light to the symbols on the rotation reels 3L, 3C, and 3R are placed side by side in the lower part inside the multi-layer panel body 5'. The cold-cathode tube 2*e* applies light toward an end part of the acrylic plate 503 for allowing light to pass through the acrylic plate 503, thereby illuminating the full face of the acrylic plate 503. In the Figure, numeral 2*g* denotes a shade disposed so as to involve the cold-cathode tubes 2*e* and 2*f* for making it possible to efficiently guide light of the cold-cathode tubes 2*e* and 2*f* to the acrylic plate 503 and the rotation reels 3L, 3C, and 3R. The shade 2*g* is bent roughly in a U-lettered shape in cross section and is fastened to the lower panel mounting boss 2*c*' together with the multi-layer panel body 5'.

Figure 39:
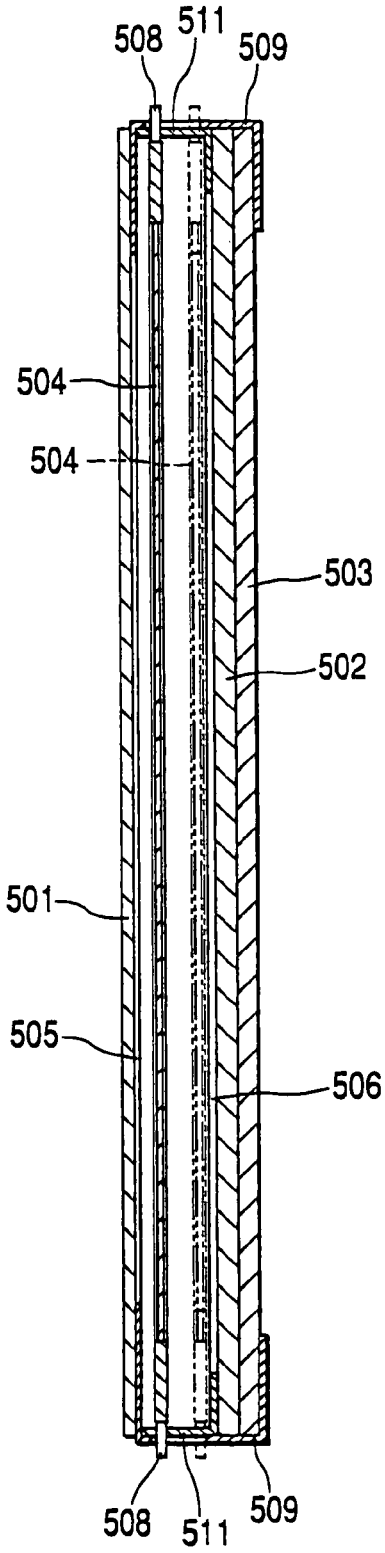
FIG. 39 is a sectional view taken on line XXXIX-XXXIX shown in FIG. 36.

The display scaling unit of the main part of the invention will be discussed in detail. As shown in FIGS. 35 and 39, the Fresnel lens 504 is formed like a rectangular shape of roughly the same dimensions as the first and the second liquid crystal panels 501, 502, is retained by a lens frame 507, and is disposed so as to be able to move back and forth between a front frame 505 and a rear frame 506.

Anchor pins 508 are projected in the proximity of the four corners of the lens frame 507 and on the other hand, hold pieces 509 each shaped roughly like a letter L are formed in the proximity of the four corners of the front frame 505 and each horizontal long hole 510 into which the anchor pin 508 is inserted for regulating the move direction of the anchor pin 508 is made in the side part of each hold piece 509 and further tab pieces 511 that can be superposed inside of the hold pieces 509 are provided in the proximity of the four corners of the rear frame 506. Each tab piece 511 is formed with an inclined long hole 512 into which the anchor pin 508 is inserted for functioning as a cam for relatively moving the anchor pin 508 along a slope.

A long hole 513 is made in an upper frame part 506*a* of the rear frame 506 and a motor shaft M1 of a motor M substantially implementing the scaling mechanism section A is inserted into the long hole 513. Moreover, a cam 514 eccentric with respect to the shaft core and having a peripheral surface touching the upper and lower inner margins of the long hole 513 is attached to the motor shaft M1.

Therefore, when the motor M is run, as shown in FIGS. 36 through 38B, the cam 514 moves the rear frame 506 up and down. As a result, the inclined long hole 512 relatively moves the Fresnel lens 504 back and forth through the anchor pin 508. The move direction of the anchor pin 508 is regulated by the horizontal long hole 510 made in the hold piece 509 of the front frame 505 and therefore the Fresnel lens 504 makes a back-and-forth horizontal move.

Figure 38A:
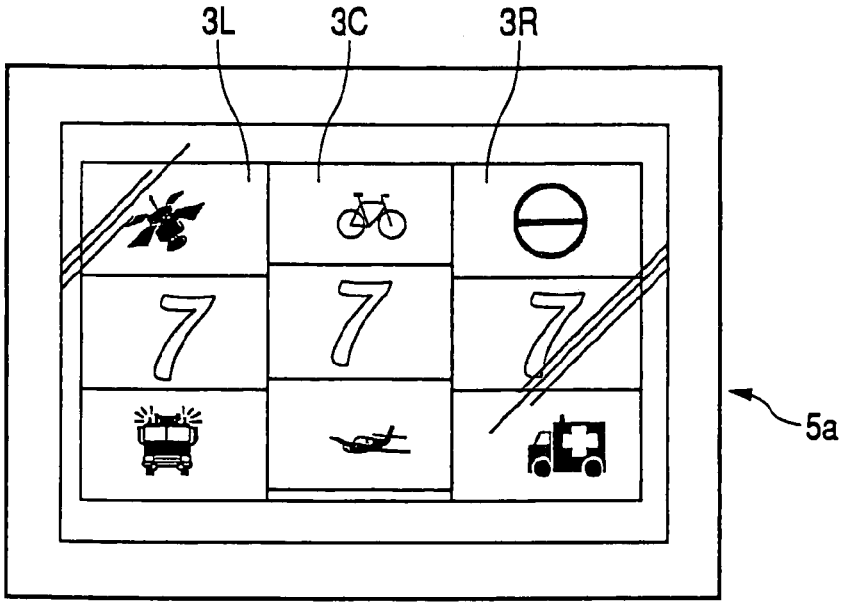
FIGS. 38A and 38B are schematic representations to show Normal display state and scaled-up display state.
Figure 38B:
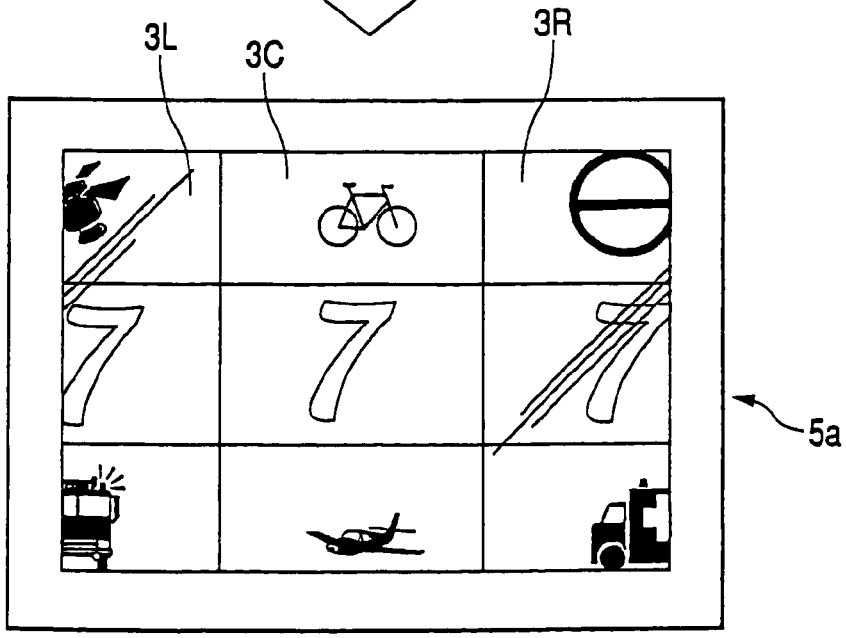

As the Fresnel lens 504 moves back and forth, the distance from the first liquid crystal panel 501 becomes relatively variable and the displayed symbols on the rotation reels 3L, 3C, and 3R of variable display means can be scaled up or down on the display screen 5*a* as shown in FIGS. 38A and 38B. By positioning the Fresnel lens 504 at the center as the standard position, as the Fresnel lens 504 is moved forward, the displayed symbols can be scaled up; as the Fresnel lens 504 is moved backward, the displayed symbols can be scaled down.

In the embodiment, the Fresnel lens 504 is disposed behind the first liquid crystal panel 501. However, as the Fresnel lens 504 is disposed in front of the first liquid crystal panel 501, it is made possible to scale up or down an image displayed by the first liquid crystal panel 501.

Figure 40:
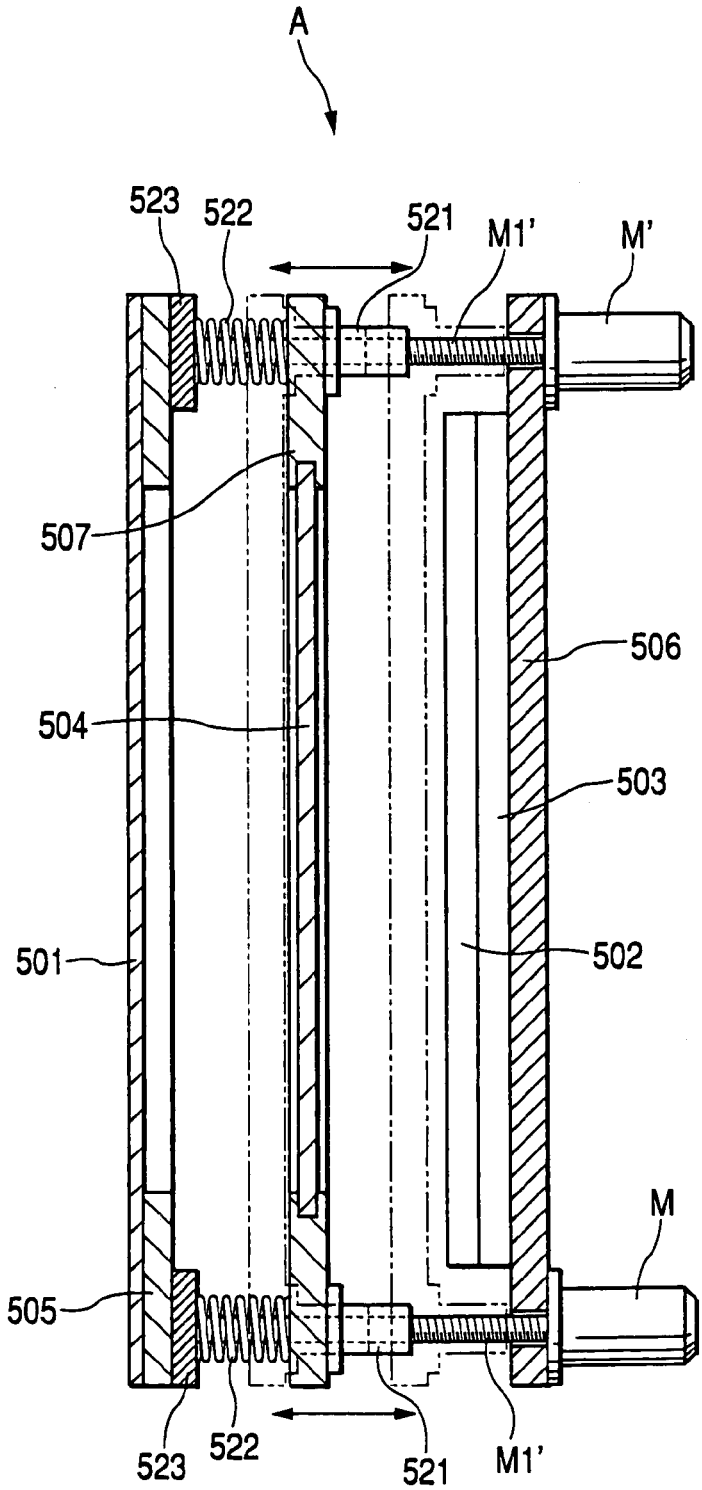
FIG. 40 is a schematic representation of display scaling means according to another embodiment of the invention.

FIG. 40 shows a scaling mechanism section A according to another embodiment of the invention. A panel display unit 5 has a multi-layer structure including a first liquid crystal panel 501, a front frame 505, a Fresnel lens 504, a second liquid crystal panel 502, an acrylic plate 503, and a rear frame 506.

In the embodiment, as shown in the Figure, four bolt shafts M1' joined at base ends to a motor M' are disposed so as to pierce the rear frame 506 and on the other hand, a screw boss 521 provided on a lens frame 507 of the Fresnel lens 504 is screwed into each bolt shaft M1'. As the bolt shaft M1' rotates, the Fresnel lens 504 can be moved back and forth, and a spring 522 is placed between the lens frame 507 and the front frame 505. Numeral 523 denotes a spring disposing seat.

According to the configuration, as the motor M' is driven, the distance between the Fresnel lens 504 and the first liquid crystal panel 501 becomes relatively variable and still symbols displayed on rotation reels 3L, 3C, and 3R can be scaled up or down. Also in the embodiment, by positioning the Fresnel lens 504 at the center as the standard position, as the Fresnel lens 504 is moved forward, the displayed symbols can be scaled up; as the Fresnel lens 504 is moved backward, the displayed symbols can be scaled down.

Figure 41:
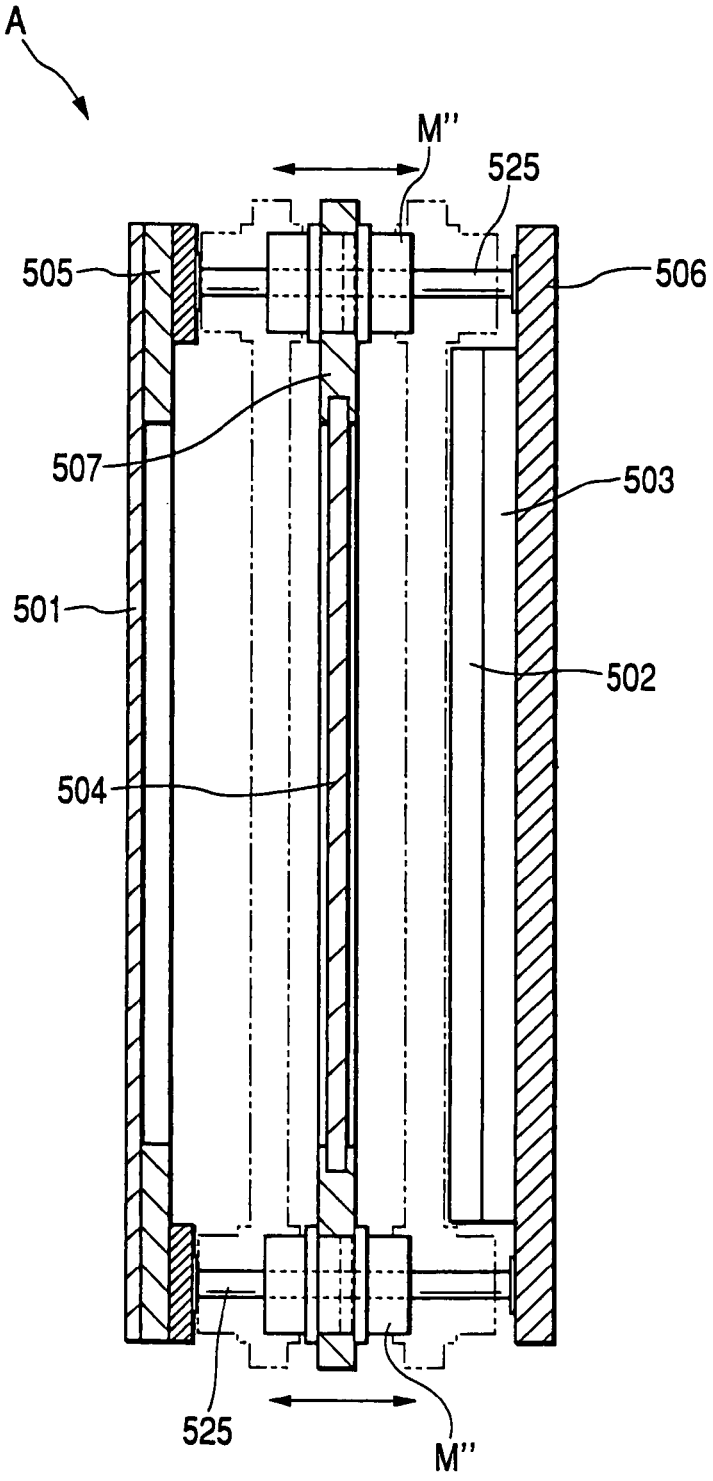
FIG. 41 is a schematic representation of display scaling means according to another embodiment of the invention.

A scaling mechanism section A shown in FIG. 41 will be discussed as still another embodiment of the invention. Also in the embodiment, a panel display unit 5 has a multi-layer structure including a first liquid crystal panel 501, a front frame 505, a Fresnel lens 504, a second liquid crystal panel 502, an acrylic plate 503, and a rear frame 506.

In the embodiment, as shown in the Figure, the front frame 505 and the rear frame 506 are joined by four connecting rods 525, and a lens frame 507 provided with an inch worm motor M" using a piezoelectric element is attached to the connecting rods 525.

According to the configuration, as the inch worm motor M" is driven, the Fresnel lens 504 can be moved back and forth together with the lens frame 507.

In the embodiments described above, the Fresnel lens 504 is used as one component of the scaling means, but a convex lens can also be used.

The convex lens is comparatively thick. Thus, in a case where the convex lens is used, it is preferable to adopt a configuration to produce scaled-up display in a spot-like manner.

Figure 42:
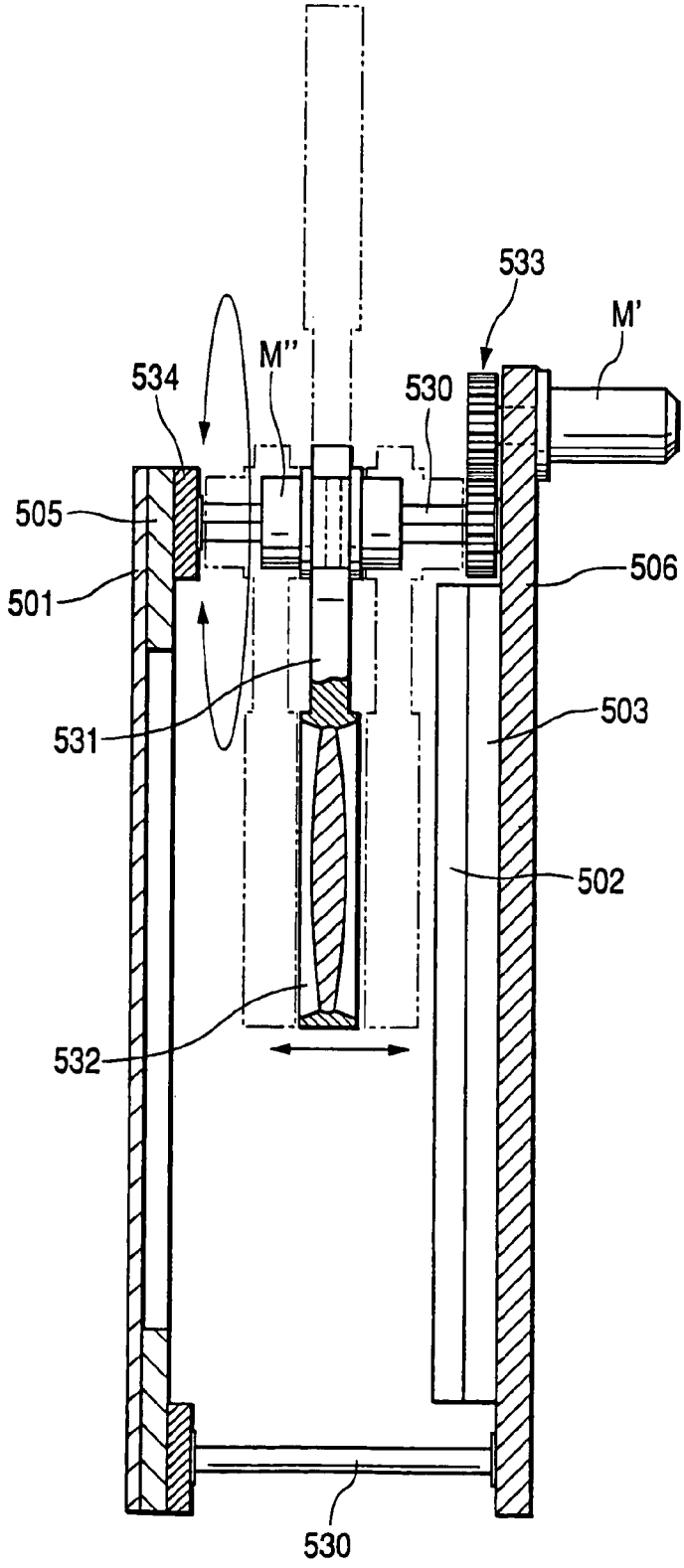
FIG. 42 is a schematic representation of display scaling means according to another embodiment of the invention.
Figure 43:
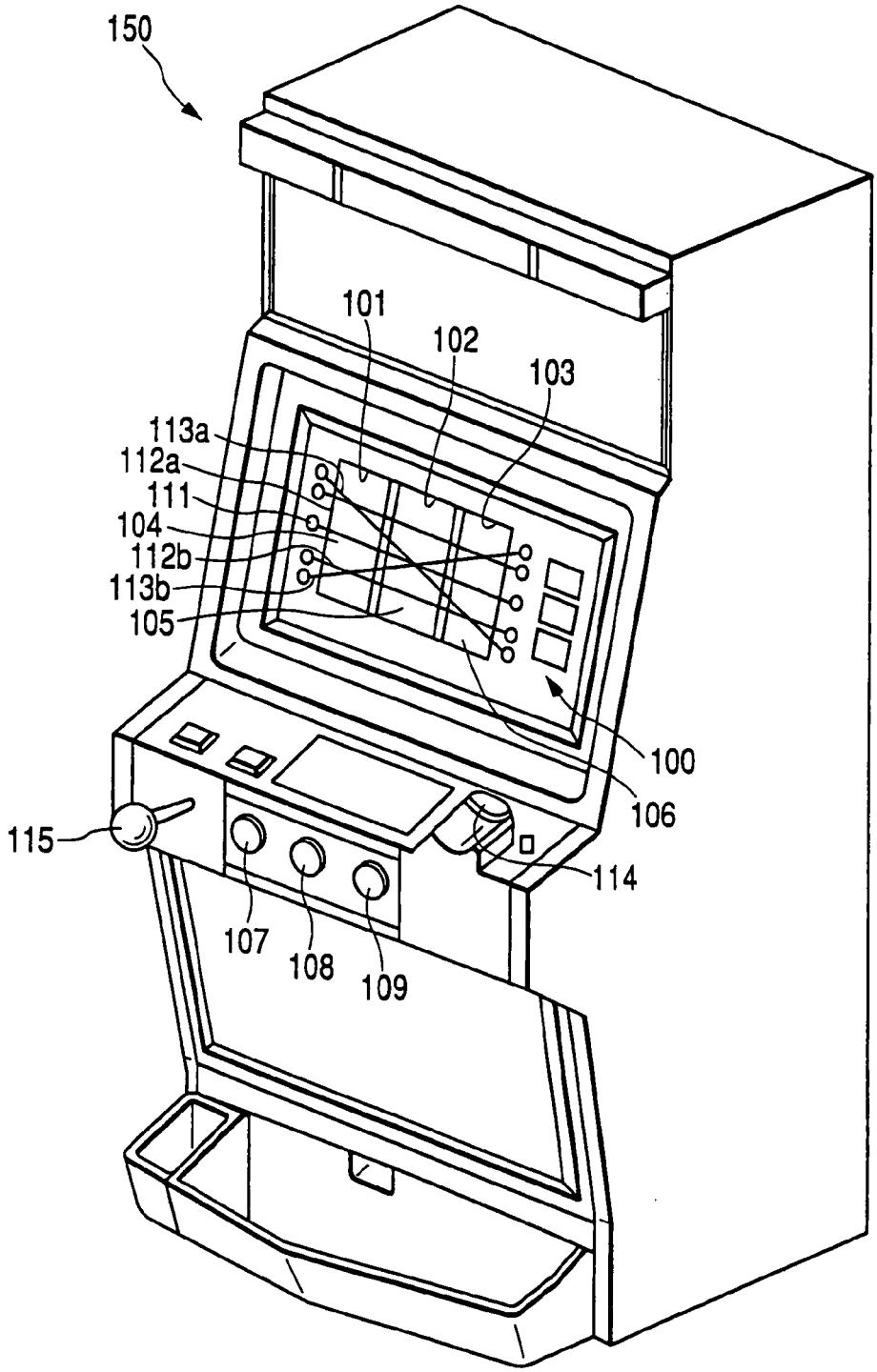
FIG. 43 is a schematic representation to show an example of a gaming machine in a related art.

As shown in FIG. 42, an arm 531 is joined through an inch worm motor M" to a shaft 530 placed between a front frame 505 and a rear frame 506 for rotation, and a spot convex lens 532 is provided at the tip of the arm 531. The shaft 530 is joined at the base end to a motor M' through a gear mechanism 533. In the Figure, numeral 534 denotes a bearing of the shaft 530.

According to the configuration, the spot convex lens 532 can be moved in parallel with panel display unit 5. The motor M' is drive as required and the spot convex lens 532 is rotated and moved in the area of display screen 5*a* and further the inch worm motor M" is driven as required, thereby moving the spot convex lens 532 back and forth, making it possible to produce scaled-up display in a spot-like manner under an appropriate magnification.

In the example shown in the Figure, the spot convex lens 532 is singly used. However, the spot convex lenses 532 can be provided in a one-to-one correspondence with a plurality of shafts 530 provided between the front frame 505 and the rear frame 506 for increasing the number of spots where scaled-up display can be produced.

The motors M and M' and the inch worm motor M" described above are controlled by a control signal from a microcomputer 40 (described later).

In the description of the configurations in the embodiments, the first and second liquid crystal panels 501 and 502 are used as the front display unit. However, an EL (electroluminescent) panels can also be used in place of the liquid crystal panels. In any way, to use such electronic displays, slim and compact display unit can be formed and moving image display is made possible, making it possible to produce extensive information display.

Thus, in the embodiment, the panel display unit 5 is provided with the display scaling unit, whereby it is made possible to scale up or down display of the necessary image and a stronger impact is given to the player; as the image is scaled up, and sharper display is produced. Therefore, the amusement of the gaming machine for the player to enjoy an effect image is still more enhanced, and it is made possible for the player to be satisfied with playing a game without getting tired of the game.

Further, as described above, by superposing the first and second liquid crystal panels 501 and 502 on each other and displaying the same images at the same positions of the first and second liquid crystal panels 501 and 502, the images overlap and can be displayed more clearly. Further, by displaying a different image on one liquid crystal panel, both images are displayed as they are combined and magical display is made possible. Specifically, while displaying character image and text information and further the pay lines, lamps, and display parts on the first liquid crystal panel 501, a background image can be displayed on the second liquid crystal panel 502. As the image on the other liquid crystal panel 502 (501) is changed with the image on one liquid crystal panel 501 (502) intact, it is made possible to produce extensive video display including magical display.

The two liquid crystal panels 501 and 502 are thus superposed on each other for producing image display, whereby clearer display and at times, more extensive display is made possible. As a result, enjoyment in gaming for the player can be increased and it becomes possible to display even information notification impressively.

By configuring so as that the video display is not produced in the range of the second liquid crystal panel 502 corresponding to the rotation reels 3L, 3C, and 3R and the symbols on the rotation reels 3L, 3C, and 3R can be seen through the second liquid crystal panel 502, the symbols on the rotation reels 3L, 3C, and 3R can be sufficiently seen through the first liquid crystal panel 501, so that symbol variation on the rotation reels 3L, 3C, and 3R can also be visually recognized at all times.

Moreover, the display scaling means makes it possible to give the player a stronger impact with the symbol display.

Operation of the player for operating the start lever 6 for rotating the three reels 3L, 3C, and 3R and operating the three stop buttons 7L, 7C, and 7R for stopping rotation of the reels 3L, 3C, and 3R will be discussed.

In the embodiment, the stop operation performed when all reels 3L, 3C, and 3R rotate is called "first stop operation," the stop operation next performed is called "second stop operation," and the stop operation performed following the second stop operation is called "third stop operation." Operating the left stop button 7L as the first stop operation is called "forward push." Operating the center stop button 7C as the first stop operation is called "center push." Operating the right stop button 7R as the first stop operation is called "reverse push."

Since the gaming machine 1 is provided with the three stop buttons 7L, 7C, and 7R, there are six different operation orders of the stop buttons. Then, the operation orders are distinguished from each other as follows: The left stop button 7L is abbreviated to "left," the center stop button 7C to "center," and the right stop button 7R to "right." To indicate the stop order, the abbreviations of the stop buttons 7L, 7C, and 7R are listed from left to right in the stop operation order. For example, when the player operates the left stop button 7L as the first stop operation, the center stop button 7C as the second stop operation, and the right stop button 7R as the third stop operation, the stop order is indicated as "left center right." In the embodiment, the six different stop orders of "left center right," "left right center," "center left right," "center right left," "right left center," and "right center left" are available.

FIG. 5 shows symbol rows each made up of 21 symbols represented on each reel 3L, 3C, 3R. The symbols are given code numbers from "00" to "20" and are stored in ROM 32 described later as a data table. The symbol rows each made up of symbols of "blue 7," "red 7," "BAR," "bell," "plum," "Replay, " and "cherry" are represented on the reels 3L, 3C, and 3R. The reels 3L, 3C, and 3R are rotated so that the symbol rows move in the arrow direction.

A table in FIG. 6 lists the winning combinations and the numbers of paid-out medals corresponding to the winning symbol combinations in each gaming state.

The gaming state is classified into the three states of ordinary gaming state (the mode in which the gaming machine (player) is in the state is also represented as "during general gaming"), ordinary gaming state in BB (the mode in which the gaming machine (player) is in the state is also represented as "during BB operation"), and RB gaming state (the mode in which the gaming machine (player) is in the state is also represented as "during RB operation"). Usually, the mode in which the gaming machine (player) is in the ordinary gaming state is represented as "during general gaming," the mode in which the gaming machine (player) is in the ordinary gaming state in BB is represented as "during BB operation," and the mode in which the gaming machine (player) is in the RB gaming state is represented as "during RB operation."

The ordinary gaming state may be further classified depending on whether or not the internal winning of BB or RB is accepted. However, the winning combinations having the possibility of accepting internal winning are similar and therefore the gaming state is classified into the three states in the table.

The types of winning combinations having the possibility of accepting internal winning are determined according to a probability lottery table (described later) and the probability lottery table is provided for each gaming state. That is, the types of prizes having the possibility of accepting internal winning become the same for games in the same gaming state.

As shown in FIG. 6, when "blue 7-blue 7-blue 7" or "red 7-red 7-red 7" is placed in a row along the activated line in the ordinary gaming state, a winning game of BB is complete and 15 medals are paid out to the player and the gaming state of the next game enters the BB gaming state.

The RB gaming state occurs when the symbol combination along the activated line is "BAR-BAR-BAR" in the ordinary gaming state or when the symbol combination along the activated line is "Replay-Replay-Replay" in the ordinary gaming state in BB (JAC IN). At this time, 15 medals are paid out to the player. The RB gaming state is a gaming state in which the player easily gains a prize of paying out 15 medals to the player with completion of the predetermined symbol combination "Replay-Replay-Replay" as the player bets one medal. The maximum number of games that can be played by the player in one RB gaming state (the number of RB games that can be played) is 12. The number of winning games that can be gained in the RB gaming state (the possible number of winning games of RB) is up to eight. That is, the RB gaming state exits if the number of games reaches 12 or if the number of winning games reaches eight. When the RB gaming state exits, a transition to the ordinary gaming state is made.

One BB exits if the player has played 30 games in the ordinary gaming state in BB or if a transition to the RB gaming state is made three times and the third RB exits. When the BB gaming state exits, a transition to the ordinary gaming state is made.

When the symbol combination along the activated line is "Replay-Replay-Replay" in the ordinary gaming state, a winning game of replay is complete. When a winning game of replay is complete, as many medals as the number of inserted medals are automatically inserted, so that the player can play a game without consuming medals.

As symbol combination "bell-bell-bell" is placed in a row along the activated line in the ordinary gaming state or the ordinary gaming state in BB, a winning game of small prize of bell is complete. When the internal winning of small prize of bell is accepted, whether or not the winning game is complete is determined by the table number (described later) and the stop order of the stop buttons 7L, 7C, and 7R by the player. Specifically, the symbol combination "bell-bell-bell" is placed in a row along the activated line and the winning game of small prize of bell is complete only if the player operates the stop buttons 7L, 7C, and 7R in the stop order of the six stop orders corresponding to the table number. If the player operates the stop buttons 7L, 7C, and 7R in any order other than the stop order corresponding to the table number, the winning game of small prize of bell becomes incomplete.

It is possible to realize completion of winning games of "small prize of cherry," "small prize of plum," and the like, in the ordinary gaming state or the ordinary gaming state in BB. The numbers of medals paid out to the player are as shown in the Figure.

In the ordinary gaming state, "stop operation assistance time period (in which referred to as "AT" in later description)" is provided for notifying the player of the stop order for realizing completion of a winning game when the internal winning of small prize of bell is accepted. When the internal winning of small prize of bell is accepted in the time period, the player can surely realize completion of a winning game.

Figure 7:
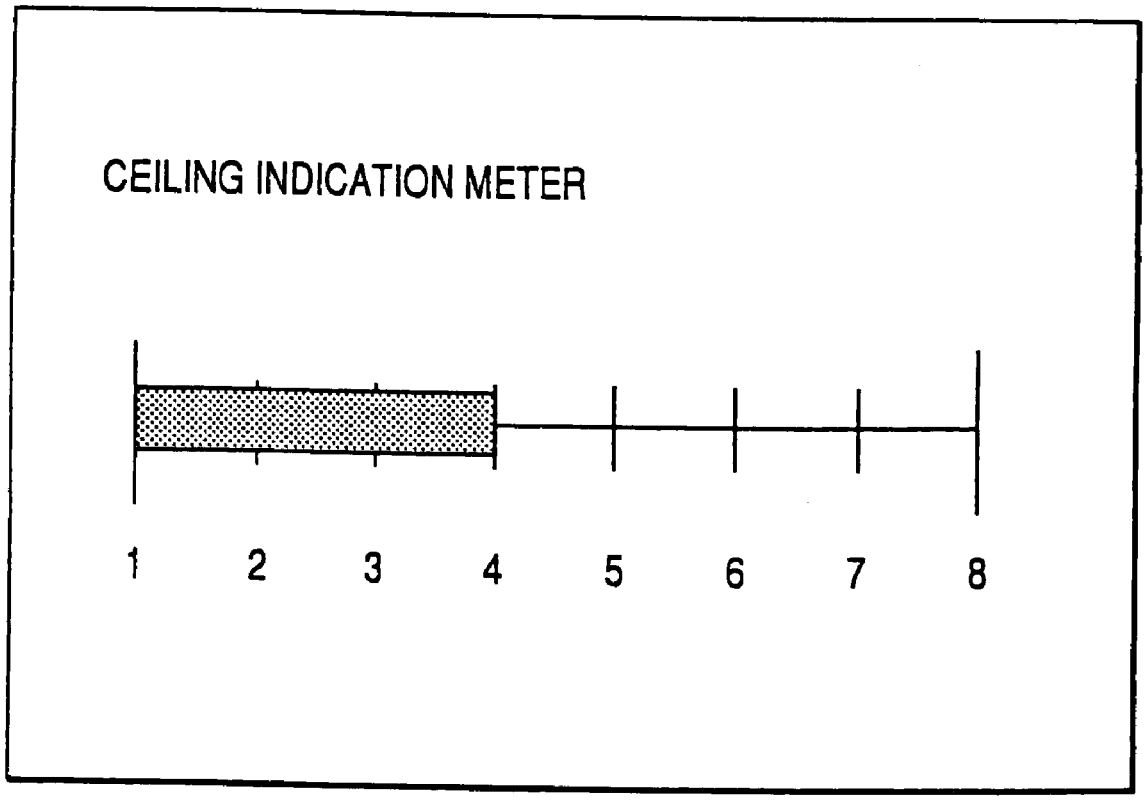
FIG. 7 is a drawing to show an example of a ceiling indication meter.

FIG. 7 is a drawing to describe an example of "ceiling indication meter" of indication means for indicating the progress until a relief measure occurs. The scale shown in the Figure indicates the difference between the total number of medals used for playing games and the total number of paid-out medals. That is, usually, the number of used medals is greater than the number of paid-out medals during the general gaming and thus the scale of the meter grows until a bonus is won. The scale of the meter starts at "1" when BB exits, and when the scale reaches "8", a relief measure (so-called "ceiling") is activated.

In the embodiment, the ceiling indication meter is displayed on the display screen 5*a*. At this time, the second liquid crystal display 502 is driven and the background of the scale portion is masked, whereby the liquid crystal display can be recognized remarkably clearly. In a case where the Fresnel lens 504 is disposed in front of the first liquid crystal display 501, the display scaling means according to the invention can be used to produce scaled-up display.

Hereinafter, the images (stop order notification images) displayed on the display screen 5*a* when the internal winning of small prize of bell is accepted in the assistance time period will be discussed with reference to FIG. 8A-8C.

Also in this case, the second liquid crystal display 502 is driven and the background of the scale portion is masked, whereby the image for notifying the player of the stop order on the liquid crystal display can be recognized extremely clearly and can also be scaled up. In FIG. 8A-8C, the stop order required for a winning game is "left right center."

Figure 8A:
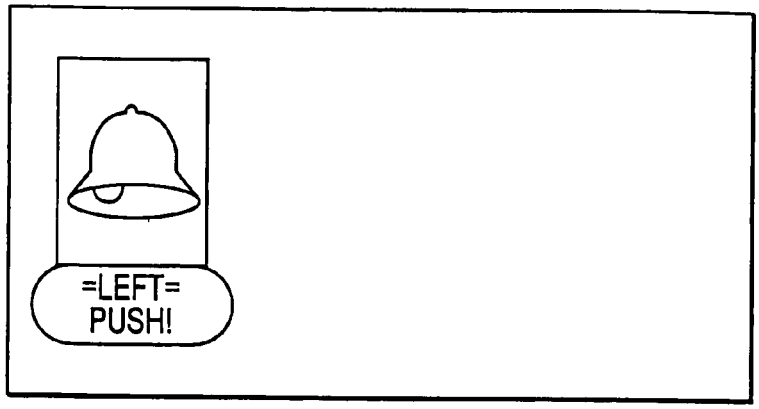
FIGS. 8A through 8C are drawings to show an example of images for notifying the player of stop order.

FIG. 8A shows the image displayed at the game start time. The symbol of a bell is displayed in the left symbol display area of the image, indicating that the internal winning of small prize of bell is accepted. Further, a message of "=LEFT= PUSH!" is displayed below the symbol of the bell, notifying the player that the stop operation required for a winning game is to operate the left stop button 7L as the first stop operation.

Figure 8B:
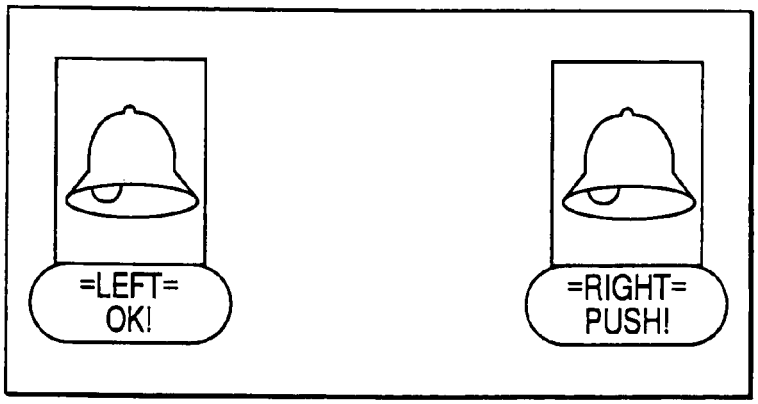

FIG. 8B shows the image displayed after the player performs the first stop operation. Another symbol of a bell is displayed in the right symbol display area of the image and a message of "=RIGHT= PUSH!" is displayed below the symbol of the bell, notifying the player that the player is to operate the right stop button 7R as the second stop operation.

Figure 8C:
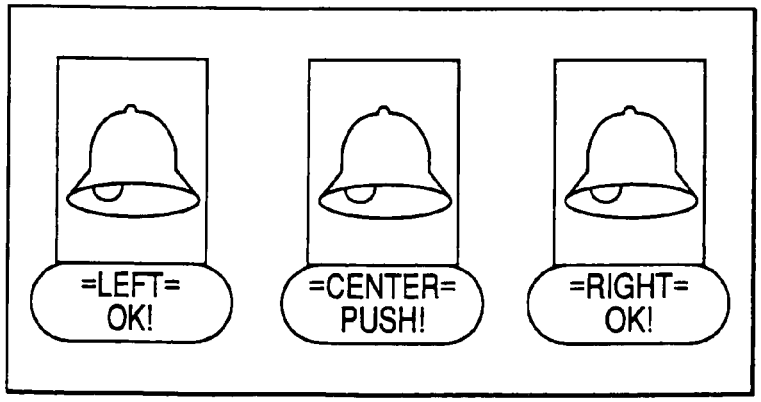
Figure 19:
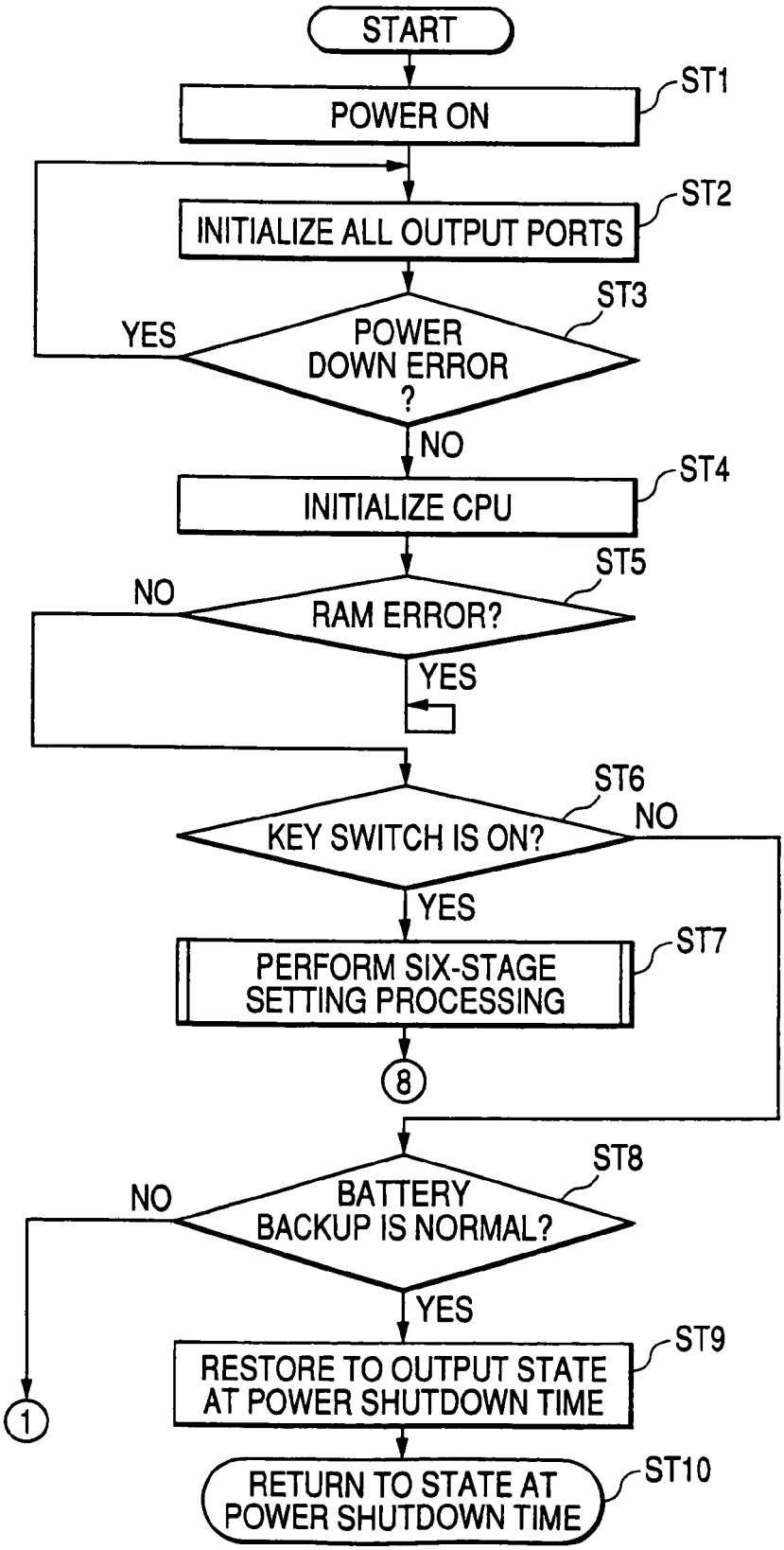
FIG. 19 is a flowchart to show processing of the main control circuit.
Figure 20:
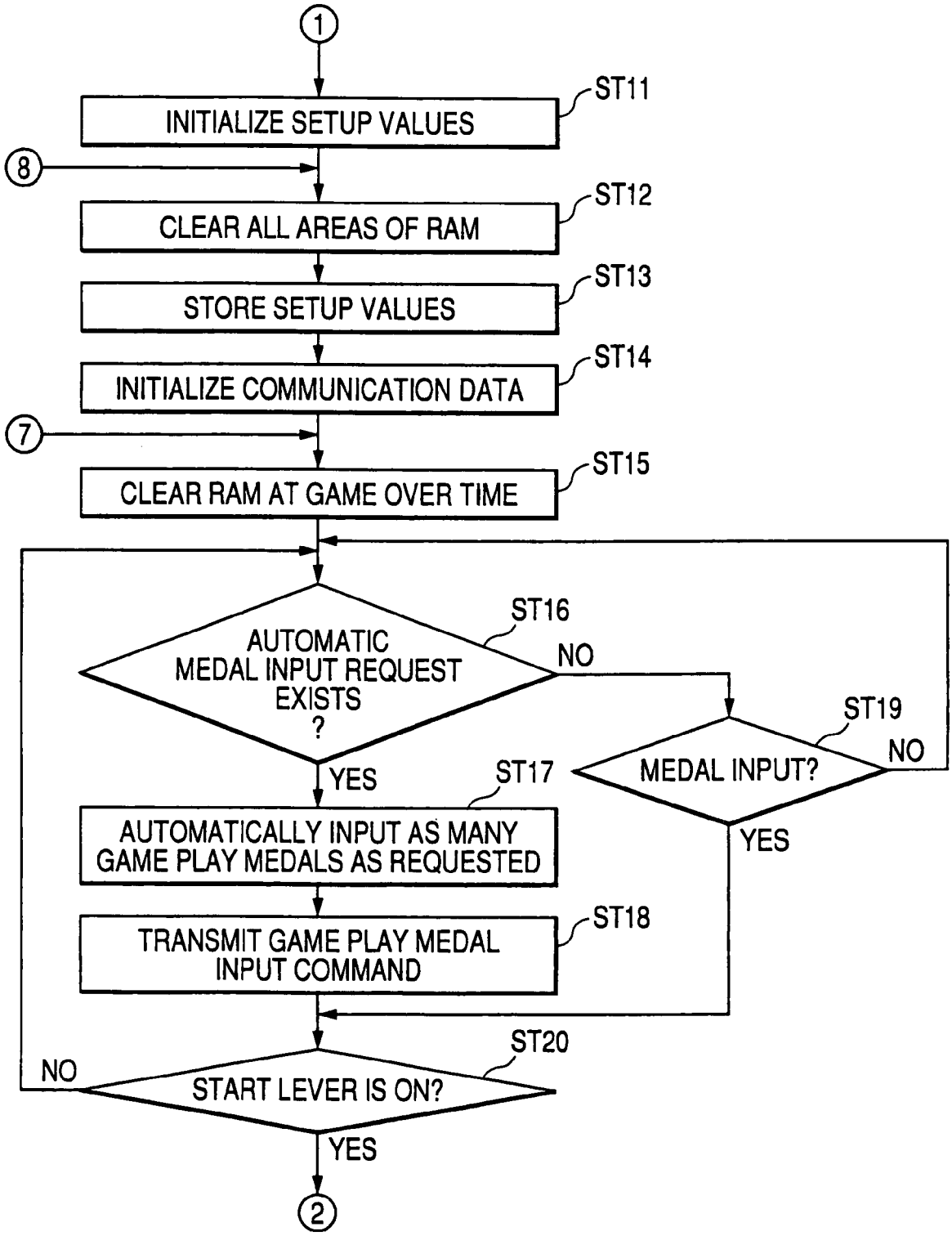
FIG. 20 is a flowchart to show processing of the main control circuit.
Figure 21:
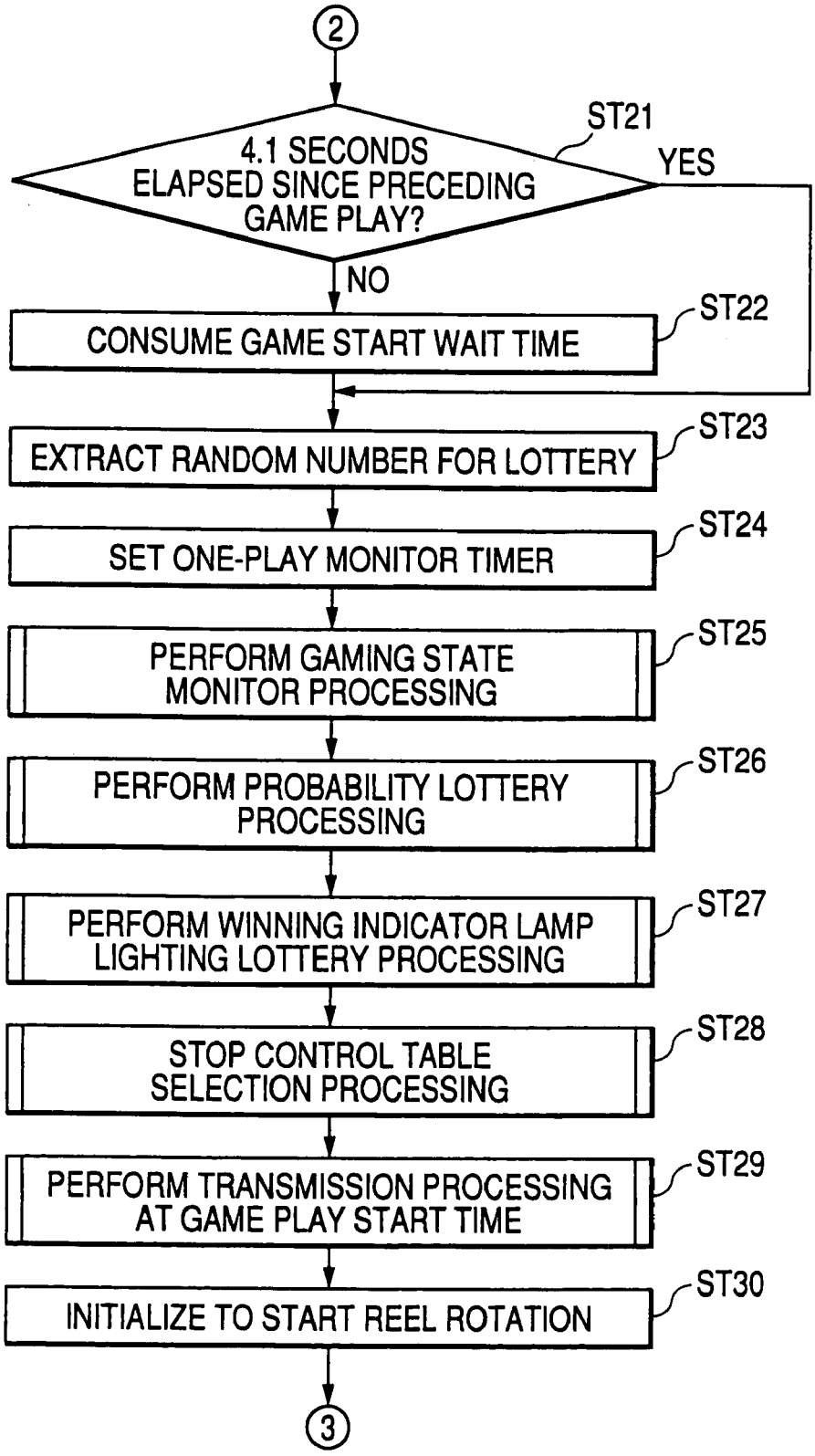
FIG. 21 is a flowchart to show processing of the main control circuit.
Figure 22:
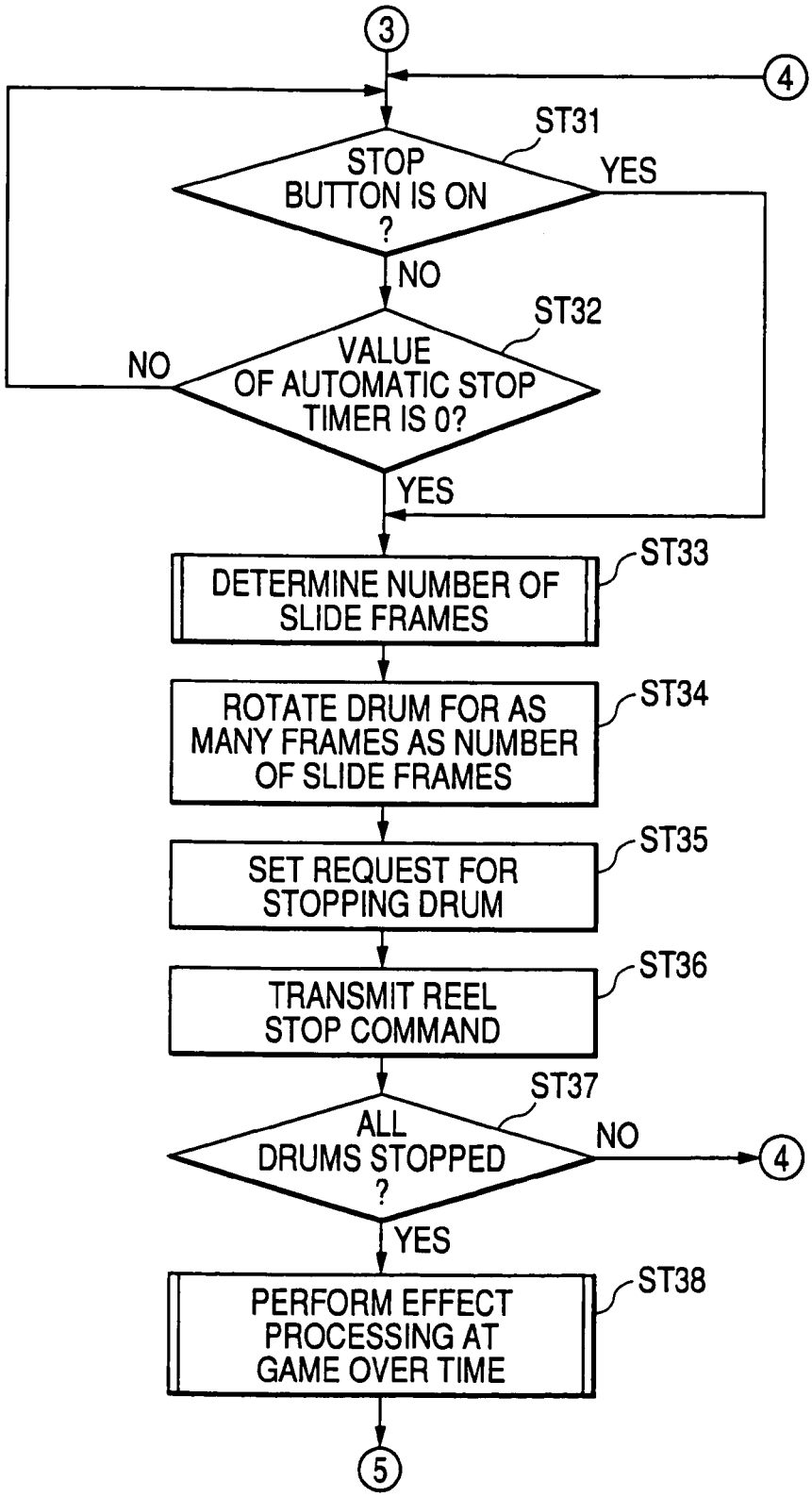
FIG. 22 is a flowchart to show processing of the main control circuit.
Figure 23:
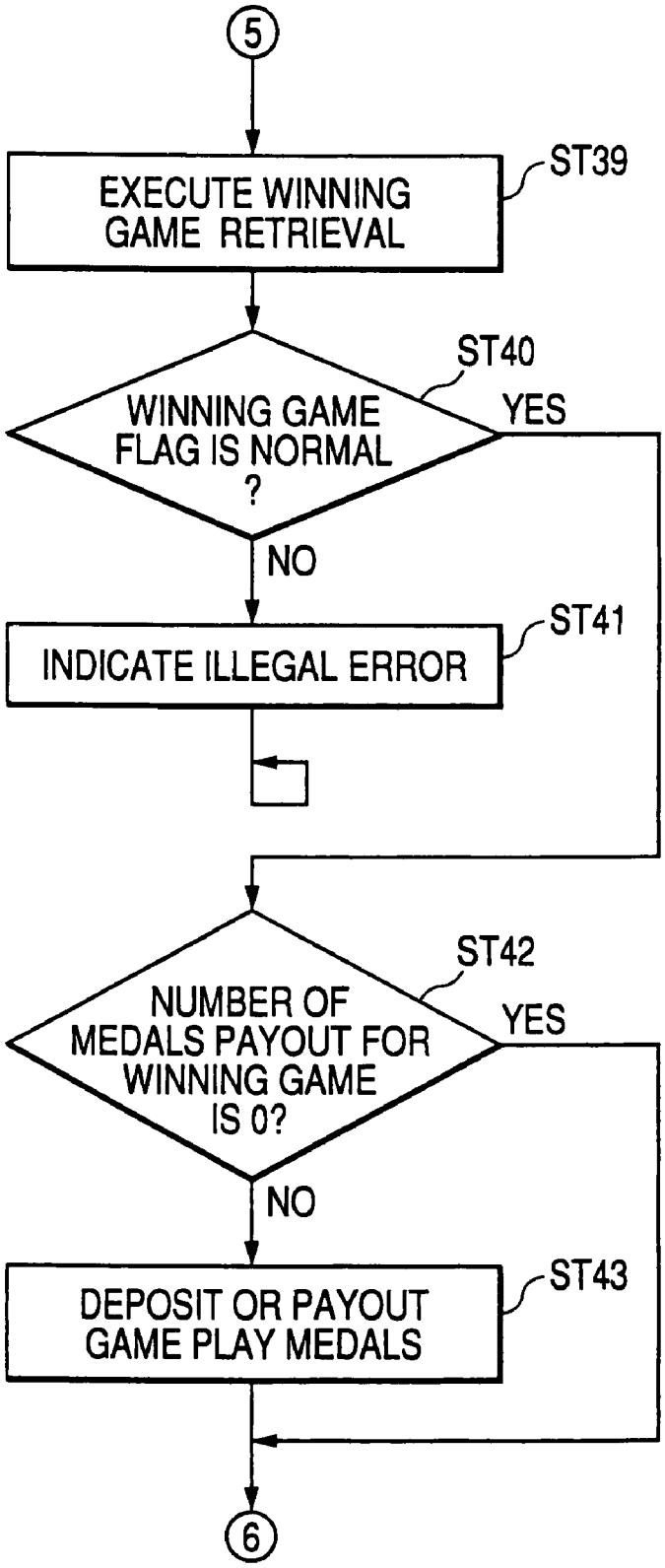
FIG. 23 is a flowchart to show processing of the main control circuit.
Figure 24:
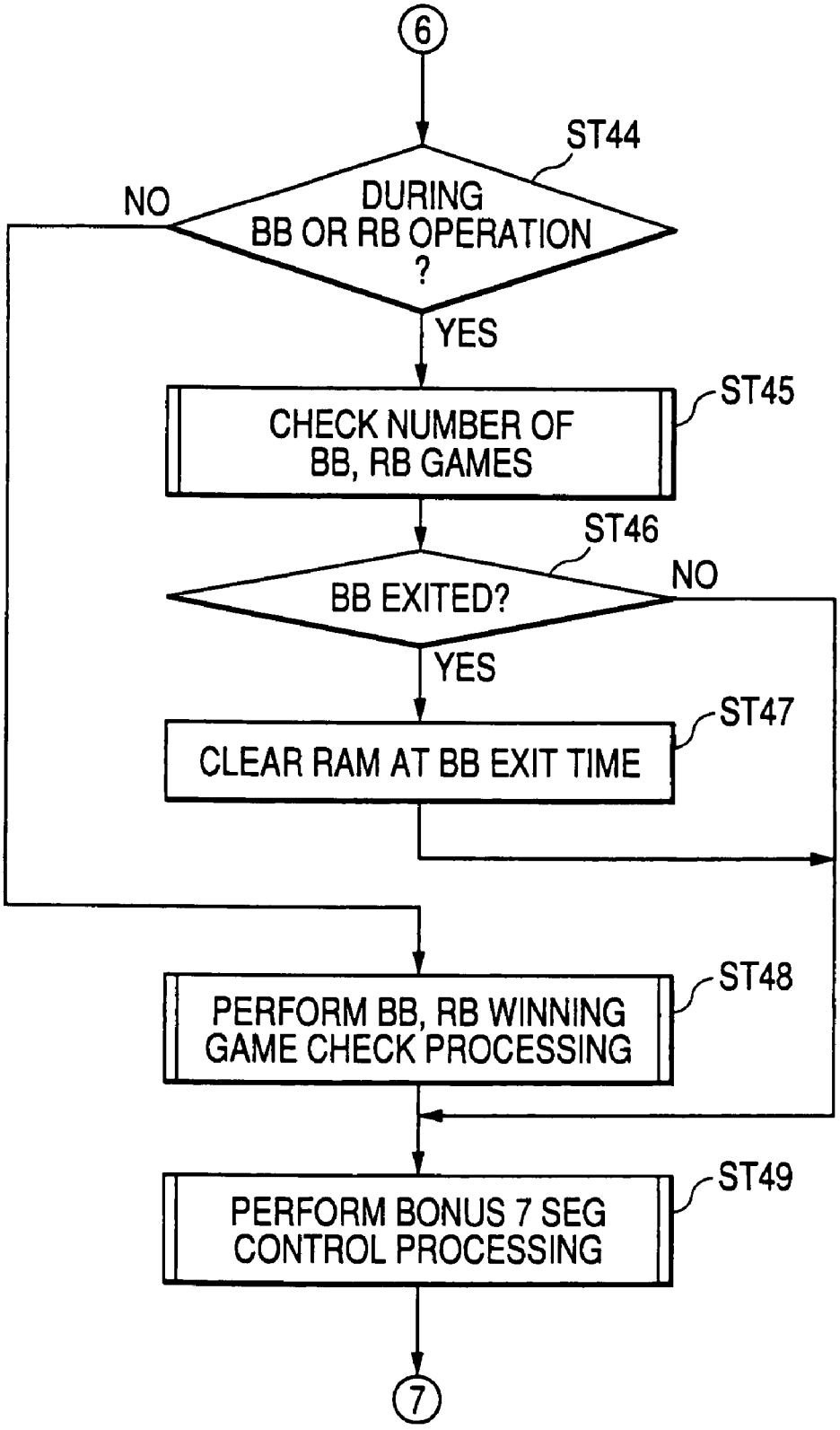
FIG. 24 is a flowchart to show processing of the main control circuit.
Figure 25:
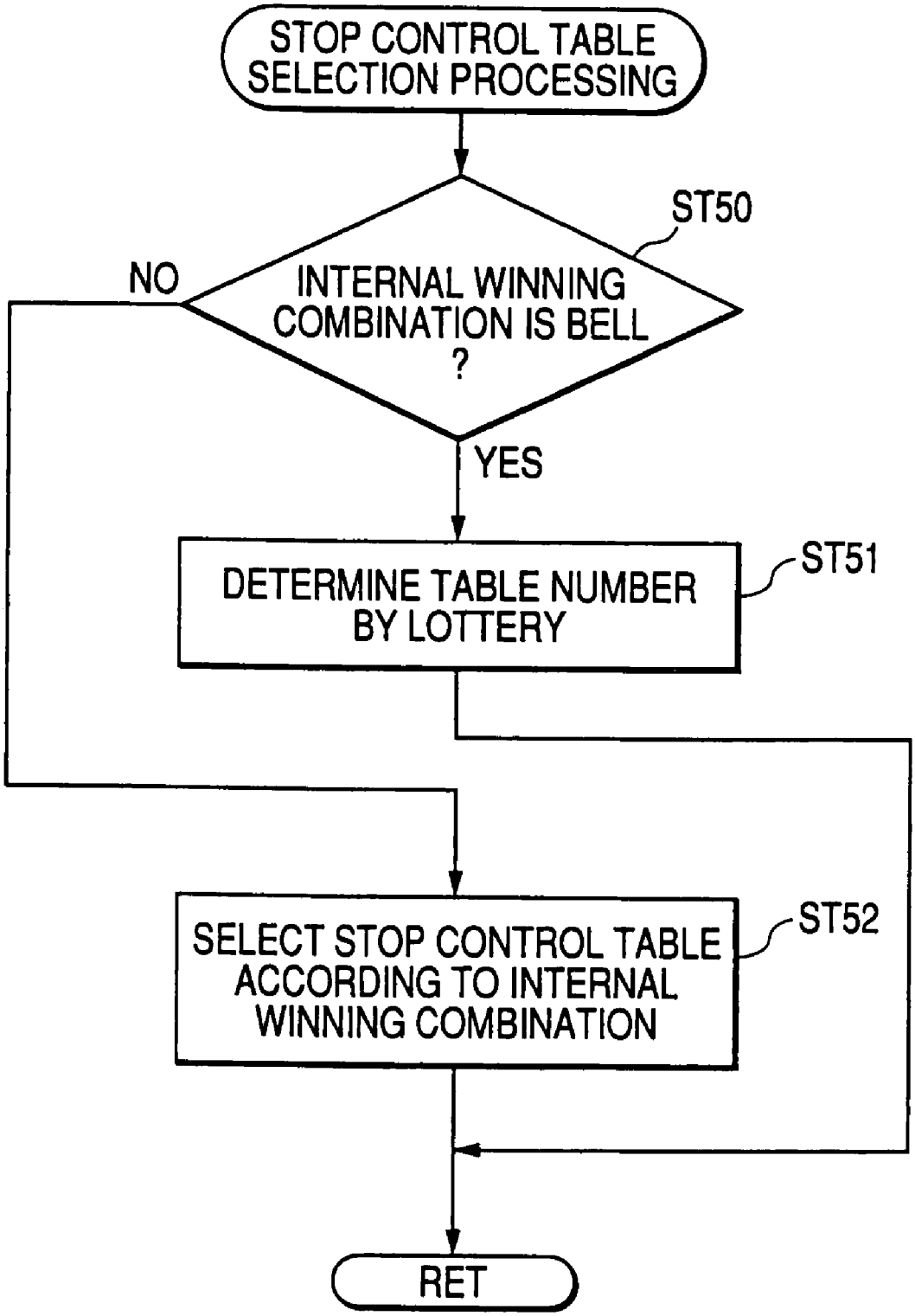
FIG. 25 is a flowchart to show stop control table selection processing.

FIG. 8C shows the image displayed after the player performs the second stop operation. Another symbol of a bell is displayed in the center symbol display area of the image and a message of "=CENTER= PUSH!" is displayed below the symbol of the bell, notifying the player that the player is to operate the center stop button 7C as the third stop operation. If the player performs the first stop operation and the second stop operation responsive to the messages displayed on the display screen 5*a*, "bell-bell-bell" is placed in a row along the activated line and the winning game of small prize of bell is complete after the player performs the third stop operation.

In FIGS. 8A through 8C, the player is notified of the stop button to next operate in order as the stop order notification mode. However, the player may be notified of the stop order at a time at the game start time. For example, the stop order can also be displayed as "left right center" on the display screen 5*a*.

Figure 3:
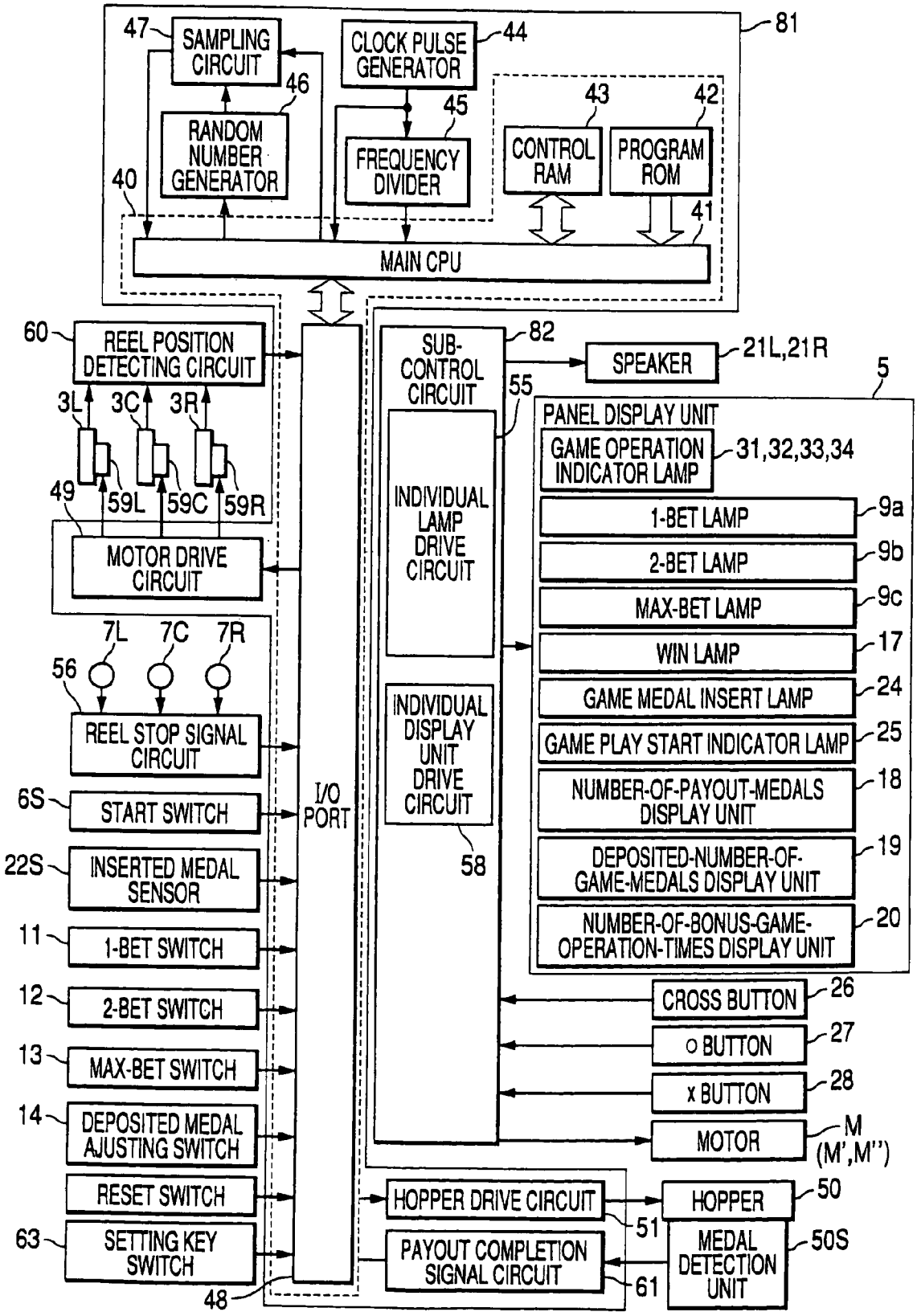
FIG. 3 is a block diagram to show the configuration of an electric circuit of the slot machine according to the embodiment of the invention.

FIG. 3 shows the circuit configuration including a main control circuit 81 for controlling the game processing operation of the gaming machine 1, peripherals (actuators) electrically connected to the main control circuit 81, and a sub-control circuit 82 for controlling the panel display unit 5 of liquid crystal display and the speakers 21L and 21R based on a control command transmitted from the main control circuit 81.

The main control circuit 81 includes the microcomputer 40 placed on the circuit board as the main component and a random number sampling circuit. The microcomputer 40 includes a CPU 41 for performing the control operation in accordance with a preset program, and ROM 42 and RAM 43, both of which are provided as a storage.

Connected to the CPU 41 are a clock pulse generation circuit 44 for generating a reference clock pulse, a frequency divider 45, a random number generator 46 for generating sampled random numbers, and a sampling circuit 47. For sampling random numbers, random number sampling may be executed in the microcomputer 40, namely, the operation program of the CPU 41. In this case, the random number generator 46 and the sampling circuit 47 can be omitted or can also be left for backup of the random number sampling operation.

The ROM 42 of the microcomputer 40 stores probability lottery tables used to determine random number sampling performed each time the player operates the start lever 6 (start operation), stop control tables for determining the reel stop state in response to operation of the stop buttons, various control commands to be transmitted to the sub-control circuit 82, and the like. The commands include a demonstration display command, a start command, an all reel stop command, a winning symbol combination (prize) command, and the like. The commands will be discussed later. The sub-control circuit 82 does not input commands, information, etc., to the main control circuit 81 and one-way communications are conducted from the main control circuit 81 to the sub-control circuit 82.

In the circuitry shown in FIG. 3, the actuators whose operation is controlled by a control signal from the microcomputer 40 include a hopper (containing a drive section for paying out medals) 50 as game play value giving means for storing medals and paying out a predetermined number of medals according to an instruction of a hopper drive circuit 51, stepping motors 59L, 59C, and 59R for rotating the reels 3L, 3C, and 3R, and the motor M (M', M") of the display scaling unit.

Further, a motor drive circuit 59 for driving and controlling the stepping motors 59L, 59C, and 59R, a hopper drive circuit 51 for driving and controlling the hopper 50, a individual lamp drive circuit 55 for driving and controlling the various lamps, and a individual display unit drive circuit 58 for driving and controlling the various display units are connected to the output section of the CPU 41 through an I/O port 48. Each of these drive circuits receives a control signal such as a drive command output from the CPU 41 and controls the operation of the corresponding actuator.

The main input signal generation means for generating an input signal required for generating a control command by the microcomputer 40 include a start switch 6S, the 1-BET switch 11, the 2-BET switch 12, the MAX-BET switch 13, the deposited medal adjusting switch 14, an inserted medal sensor 22S, a reel stop signal circuit 56, a reel position detecting circuit 60, and a payout completion signal circuit 61. These components are also connected to the CPU 41 through the I/O port 48.

The start switch 6S detects the player operating the start lever 6. The inserted medal sensor 22S detects a medal inserted to the medal insertion slot 22. The reel stop signal circuit 56 generates a stop signal as the player operates each stop button 7L, 7C, 7R. The reel position detecting circuit 60 receives a pulse signal from a reel rotation sensor and supplies a signal for detecting the position of each reel 3L, 3C, 3R to the CPU 41. The payout completion signal circuit 61 generates a signal for detecting completion of medal payout when the count of a medal detection unit 50S (the number of medals paid out from the hopper 50) reaches the specified number of medals.

In the circuitry shown in FIG. 3, the random number generator 46 generates random numbers contained in a given numeric value range and the sampling circuit 47 samples one random number at the appropriate timing after the player starts the start lever 6. The internal winning combination is determined based on the random number thus sampled and the probability lottery table stored in the ROM 42. After the internal winning combination is determined, random number sampling is again performed to select a stop control table.

After rotation of each of the reels 3L, 3C, and 3R is started, the number of drive pulses supplied to each of the stepping motors 59L, 59C, and 59R and the counts are written into a predetermined area of the RAM 43. A reset pulse is obtained every revolution of the reel 3L, 3C, 3R and the reset pulses are input to the CPU 41 through the reel position detecting circuit 60. The drive pulse counts written in the RAM 43 are cleared to "0" according to the reset pulses thus obtained. Accordingly, the counts corresponding to the rotation positions of the reels 3L, 3C, and 3R within the range of one revolution are stored in the RAM 43.

A symbol table is stored in the ROM 42 to relate the rotation positions of the reels 3L, 3C, and 3R and the symbols drawn on the outer peripheral surfaces of the reels to each other. In the symbol table, the code numbers given in sequence every given rotation pitch of each reel 3L, 3C, 3R based on the rotation position where the reset pulse is generated and the symbol codes indicating the symbols provided in one-to-one correspondence with the code numbers are related to each other.

Further, a winning symbol combination table is stored in the ROM 42. The winning symbol combination table lists the symbol combinations of winning games, the numbers of paid-out medals for the winning games, and the winning game determination codes representing the winning games in association with each other. The winning symbol combination table is referenced at the stop control time of the left reel 3L, the center reel 3C, the right reel 3R and when the winning game is confirmed after all reels are stopped.

When the internal winning is accepted according to lottery processing based on the random number sampling (probability lottery processing), the CPU 41 sends the stop control signal of the reels 3L, 3C, and 3R to the motor drive circuit 49 based on the operation signal sent from the reel stop signal circuit 56 at the timing at which the player operates the stop buttons 7L, 7C, and 7R, and the selected stop control table.

In the stop state indicating completion of the winning game of internal winning combination, the CPU 41 supplies a payout command signal to the hopper drive circuit 51 for paying out a predetermined number of medals to the player from the hopper 50. At the time, the medal detection unit 50S counts the number of medals paid out from the hopper 50. When the count reaches the specified number of medals, a medal payout completion signal is input to the CPU 41, which then stops driving the hopper 50 through the hopper drive circuit 51 and terminates the medal payout processing.

Figure 4:
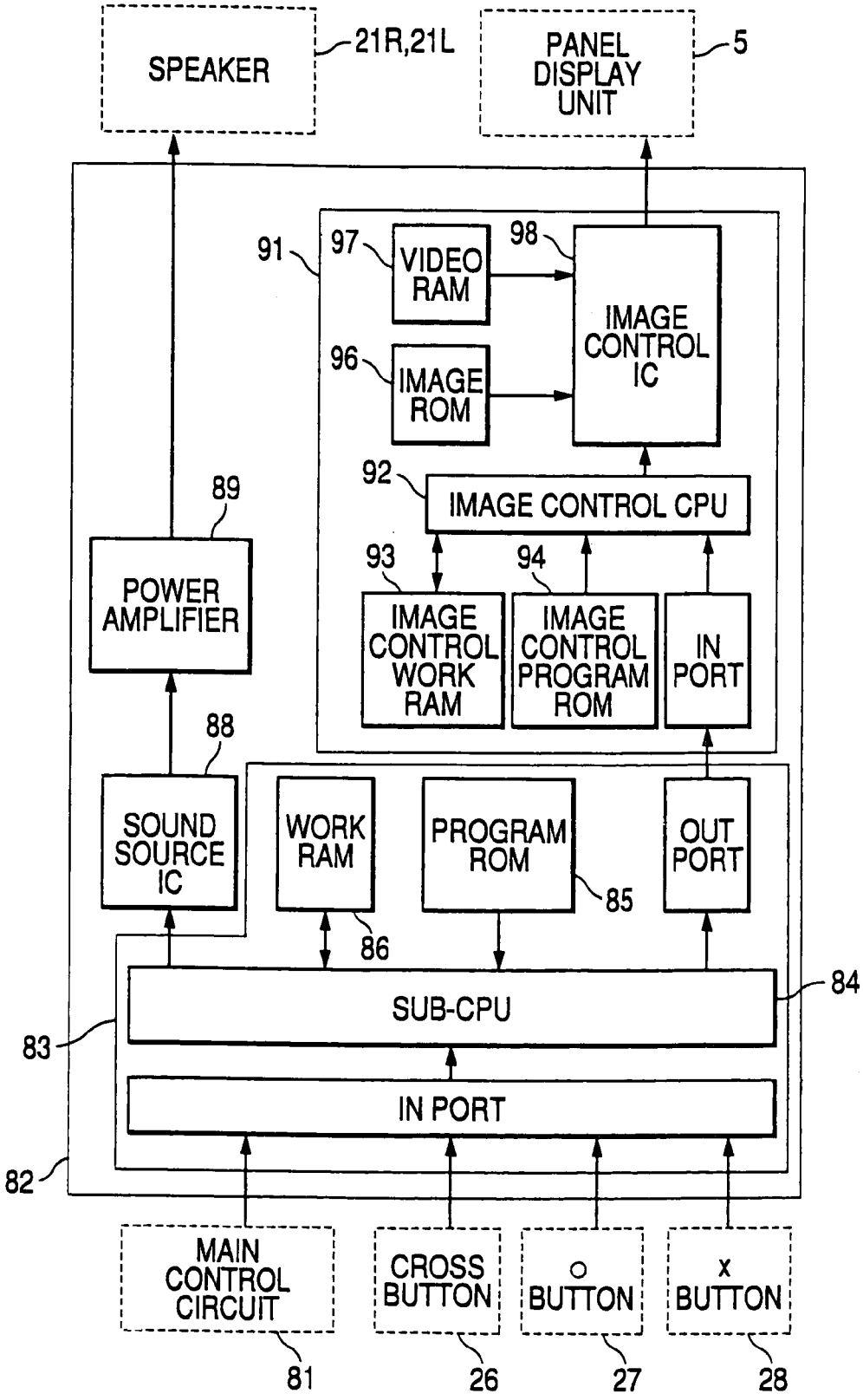
FIG. 4 is a block diagram to show the configuration of a sub-control circuit of the slot machine according to the embodiment of the invention.

FIG. 4 is a block diagram to show the configuration of the sub-control circuit 82. The sub-control circuit 82 performs display control of various lamp indications (1-BET lamp 9*a*, 2-BET lamp 9*b*, MAX-BET lamp 9*c*, and WIN lamp 17), various display units (payout display unit 18, deposited-number-of-game-medals display unit 19, and number-of-bonus-game-operation-times display unit 20), and other extensive images on the panel display unit 5 and also performs drive control of the second liquid crystal panel 502 and output control of sound from the speakers 21L and 21R based on the control commands from the main control circuit 81. In a case where the shutter is mechanically structured, the sub-control circuit 82 is configured to execute other controls such as a control of a motor as a shutter drive source.

The sub-control circuit 82, which is implemented on a separate circuit board from the circuit board implementing the main control circuit 81, is made up of a microcomputer (sub-microcomputer) 83 as the main component, an image control circuit 91 as display control means of the panel display unit 5, a sound source IC 88 for controlling sound output from the speakers 21L and 21R, and a power amplifier 89.

The sub-microcomputer 83 includes a sub-CPU 84 for performing the control operation following a control command transmitted from the main control circuit 81, program ROM 85 as storage means, and work RAM 86. The sub-control circuit 82 does not include a clock pulse generation circuit, a frequency divider, a random number generator, or a sampling circuit, but executes random number sampling in an operation program of the sub-CPU 84.

The sub-microcomputer 83 includes a number-of-notification-times counter and a number-of-AT-times stock counter in a predetermined storage area. The number-of-notification-times counter stores the remaining number of notification times of the push order in the stop operation assistance time period. When the value of the counter is "1" or more, the gaming machine (player) is in the stop operation assistance time period. The number-of-AT-times stock counter stores information concerning the remaining number of times of occurrence of the stop operation assistance time period.

The program ROM 85 stores a control program executed in the sub-CPU 84. The work RAM 86 is used as temporary storage means for the sub-CPU 84 to execute the control program.

The image control circuit 91 includes an image control CPU 92, an image control work RAM 93, image control program ROM 94, image ROM 96, video RAM 97, and an image control IC 98. The image control CPU 92 determines the display contents on the panel display unit 5 in accordance with an image control program stored in the image control program ROM 94 based on the parameters set in the sub-microcomputer 83. The image control program ROM 94 stores the image control program involved in display on the panel display unit 5 and various selection tables. The image control work RAM 93 is used as temporary storage means for the image control CPU 92 to execute the image control program. The image control IC 98 forms an image responsive to the display contents determined by the image control CPU 92 and outputs the image to the panel display unit 5. The image ROM 96 stores dot data for forming an image. The video RAM 97 is used as temporary storage means for the image control IC 98 to form an image.

Hereinafter, the probability lottery tables will be discussed with reference to FIGS. 9A and 9B.

The probability lottery tables are referenced in probability lottery processing. FIG. 9A shows the probability lottery table used during general gaming and FIG. 9B shows the probability lottery table used during general gaming in BB for determining the internal winning combination of each game.

In each table, the random number range is from "0" to "16383" and one extracted from the numeric values in the range is used to determine the internal winning combination.

For example, if the extracted random number is "2851" during general gaming, the internal winning combination of the game becomes "bell." If the extracted random number lies in the range of from "11036" to "16383" during general gaming, the internal winning combination of the game becomes "blank."

Hereinafter, the stop control tables used when the internal winning of small prize of bell is accepted will be discussed with reference to FIGS. 10 to 14.

A stop control table number section table shown in FIG. 10 is a table for determining the stop control table referenced for performing stop control of the reels 3L, 3C, and 3R if the internal winning of small prize of bell is accepted. That is, if the internal winning of small prize of bell is accepted, any one of the six stop control tables is referenced and stop control is performed based on the stop control table.

FIG. 11 shows the relationship between the stop control order of the reels 3L, 3C, and 3R in each table selected in FIG. 10 and completion/incompletion of winning game. For example, when the table number selected according to the stop control table number section table in FIG. 9 is "1", if the stop order is "left center right," the player wins the game of bell. However, if the stop order is not "left center right," the player loses the game of bell. That is, to win the game of bell, the internal winning combination needs to be bell and the player needs to stop the reels 3L, 3C, and 3R in the stop order corresponding to the stop control order in the corresponding table number.

Specific stop control of the reels 3L, 3C, and 3R when the internal winning combination is bell will be discussed with reference to FIGS. 12 through 14.

The stop control table lists the stop operation positions and the stop control positions of the reels 3L, 3C, and 3R. The stop operation position represents the code number of the symbol positioned on the center line 8*a* (specifically, the symbol whose center is positioned above the center line 8*a* and is nearest to the position of the center line 8*a*) when the player operates the stop button 7L, 7C, 7R provided corresponding to the reel 3L, 3C, 3R. The stop control position represents the code number of the symbol stopped and displayed at the position of the center line 8*a* when each of the reels stopped by the player actually stops. In the embodiment, the number of slide frames is four at the maximum. For example, when "cherry" with code number 12 arrives at the position of the center line 8*a* while the right reel 3R is rotating, if the player operates the stop button 7R, stop control of the right reel 3R can be performed so as to stop and display "blue 7" with code number 08 at the position of the center line 8*a*.

FIG. 12 shows a winning stop control table. The winning stop control table is used when stop control of the reels is performed so that "bell-bell-bell" is placed in a row along the activated line and the winning game of small prize of bell is complete after the internal winning of small prize of bell is accepted.

In FIG. 12, the stop control position of the left reel 3L is any of code number "03", "08", "11", "15", or "19" and the symbols corresponding to these code numbers are bell.

In FIG. 12, the stop control position of the center reel 3C is any of code number "03", "07", "11", "15", or "19" and the symbols corresponding to these code numbers are bell.

In FIG. 12, the stop control position of the right reel 3R is any of code number "01", "05", "10", "14", or "18" and the symbols corresponding to these code numbers are bell.

If the winning stop control table shown in FIG. 12 is thus used for stop control of the reels 3L, 3C, and 3R, "bell-bell-bell" is stopped and displayed at the position of the center line 8*a*, namely, at the centers of the display windows 4L, 4C, and 4R, and the winning game is complete.

FIG. 13 shows a "forward push, center push losing stop control table". This table is used when stop control of the reels is performed so that "bell-bell-bell" is not placed in a row along the activated line (the winning game of small prize of bell is incomplete) after the internal winning of small prize of bell is accepted. The stop control positions corresponding to the stop operation positions of the left reel 3L and the center reel 3C are the same as those shown in FIG. 11.

In FIG. 13, the stop control position of the right reel 3R is any of code number "02", "06", "11", "15", or "19" and the symbols corresponding to these code numbers are "Replay."

If the forward push, center push losing stop control table shown in FIG. 13 is thus used for stop control of the reels 3L, 3C, and 3R, "bell-bell" is stopped and displayed at the centers of the display windows 4L and 4C, and "Replay" is stopped and displayed at the center of the display window 4R and thus the winning game of small prize of bell becomes incomplete.

FIG. 14 shows a reverse push losing stop control table. This table is used when stop control of the reels is performed so that "bell-bell-bell" is not placed in a row along the activated line (the winning game of small prize of bell is incomplete) after the internal winning of small prize of bell is accepted. The stop control positions corresponding to the stop operation positions of the center reel 3C and the right reel 3R are the same as those shown in FIG. 11.

In FIG. 14, the stop control position of the left reel 3L is any of code number "04", "09", "12", "17", or "20" and the symbols corresponding to these code numbers are "Replay."

If the reverse push losing stop control table shown in FIG. 14 is thus used for stop control of the reels 3L, 3C, and 3R, "Replay" is stopped and displayed at the center of the left display window 4L and "bell-bell" is stopped and displayed at the centers of the display windows 4C and 4R, and thus the winning game of small prize of bell becomes incomplete.

In the embodiment, the six different stop orders are adopted and only when the player performs stop operation in any one of the six stop orders, "bell-bell-bell" is placed in a row along the activated line and the winning game is complete. Thus, whether or not "bell-bell-bell" is placed in a row along the activated line may be determined when the player performs the second stop operation. This case applies, for example, if the table number "1" (the corresponding stop order is "left center right") is adopted and the player operates the left reel 3L as the first stop operation. That is, if the player performs the first stop operation, whether or not "bell-bell-bell" is placed in a row along the activated line may be not necessarily clear. In the embodiment, "bell-bell-bell" is always placed in a row along the center line 8*a*. Then, in the embodiment, the two losing stop control tables are used as shown in FIGS. 12 and 13. If the table number is 2, 3, 4, 5, or 6, as the player performs stop operation in the stop order of "left right center," "center left right," "center right left," "right left center," or "right center left," the winning game of small prize of bell becomes complete.

A ceiling-number-of-AT-times selection table and an AT activation lottery table will be discussed with reference to FIGS. 15A and 15B. The random number range is "0" to "0495" for the ceiling-number-of-AT-times selection table and "0" to "255" for the AT activation lottery table.

One AT corresponds to 10 games. The ceiling-number-of-AT-times selection table is used to determine how many times the AT is to be generated. The number of AT times selected in one AT lottery is any of one, two, five, 10, or 30.

In the table, the lottery value is subtracted from the extracted random number in order from the top row to the bottom row and the value in the row where the result becomes minus is adopted as the number of AT times. For example, if the extracted random number is "4021", "2356" of the lottery value in the first row is subtracted from "4021" and a value "1665" is obtained. Since this value is plus, further "1512" of the lottery value in the second row is subtracted from "1665" and a value "153" is obtained. Since this value is plus, further "196" of the lottery value in the third row is subtracted from "153" and a value "−43" is obtained. Here, the minus value results and thus the number of AT times becomes five.

The AT activation lottery table is used to determine whether or not one AT is to be activated. The random number range is "0" to "255". Here, if activation is selected, the number of stop button push order notification times is set to 10 (games). That is, here the AT is started. The lottery method is similar to that with the ceiling-number-of-AT-times selection table described above.

A ceiling activation selection table and a ceiling meter shift selection table will be discussed with reference to FIGS. 16A and 16B. The random number range is "0" to "255" for the ceiling activation selection table. The numeric values listed in the ceiling meter shift selection table are the numeric values each indicating the difference between the total number of medals used for playing games and the total number of paid-out medals, which will be hereinafter referred to as the medal number difference value, used as the reference for determining whether or not the scale of the meter is to be shifted.

The ceiling activation selection table is used after BB exits for determining the medal number difference value to activate the next ceiling. When "1200" in the table is selected, when the difference between the total number of medals used for playing games and the total number of paid-out medals reaches "1200", the ceiling AT of a relief measure is activated. Likewise, when "1500" is selected, the difference reaches "1500", the ceiling AT is activated; and when "1800" is selected, the difference reaches "1800", the ceiling AT is activated.

Next, the ceiling meter shift selection table is used to determine indication of the ceiling meter level based on the selected medal number difference value to activate the ceiling AT and the current medal number difference value. As a specific indication method, the level in the row of the value closest to the current medal number difference value and not exceeding it among the numeric values under the column of the current selected medal number difference value to activate the ceiling AT is indicated. For example, if the current selected medal number difference value to activate the ceiling AT is "1200" and the current medal number difference value is "821", level 5 is indicated. Here, if the medal number difference value reaches "900", the meter indication shifts to level 6.

The commands will be discussed with reference to FIGS. 17 and 18. The commands are transmitted only in one way from the main control circuit 81 to the sub-control circuit 82. The main control circuit 81 and the sub-control circuit 82 are connected by 16 data signal lines and one signal line. Each command is made up of two, four, or six bytes; to transmit the command over the 16 data signal lines, the command is transmitted in one, two, or three sequences as one command.

Among the commands, a start command will be discussed. The type of internal winning combination of the game and the gaming state and the stop control table number selected if the internal winning combination is bell are transmitted as one command. Other commands are similar to the start command. FIGS. 17 and 18 show the commands by way of example; in addition to the commands, information required for the sub-control circuit 82 to perform control is transmitted.

Next, the control operation of the CPU 41 of the main control circuit 81 will be discussed with reference to main flowcharts of FIGS. 19 through 25.

To begin with, power is turned on (step (ST) 1) and the CPU 41 initializes all output ports (ST2). Subsequently, whether or not a power down error occurs is determined (ST3). If a power down error occurs, the process proceeds to ST2; if a power down error does not occur, the process proceeds to ST4. At ST4, the CPU 41 is initialized. Subsequently, whether or not a RAM error occurs is determined (ST5). If a RAM error occurs, the RAM error is indicated. Specifically, "rr" is indicated on medal payout indicator made up of seven-segment LEDs. The RAM error is an error in which RAM 78 cannot normally be written or read.

If a RAM error does not occur, whether or not a setting key switch is on is determined (ST6). If the setting key switch 63 is on, six-stage setting processing (ST7) is performed and then the process goes to ST12. If the setting key switch is off, the process goes to ST8. At ST8, whether or not battery backup is normal is determined. If battery backup is normal, the return address and the unused area of the RAM 78 are cleared and then all registers are restored to the output state at the power shutdown time (ST9) and an input port is updated to the state at the power restoration time and the state returns to the state at the power shutdown time (ST10).

If battery backup is not normal, the setup values are initialized (ST11). Subsequently, all areas of the RAM 78 are cleared (ST12). ST12 and the later steps are also executed after the six-stage setting processing is performed if it is determined at ST6 that the setting key switch is on. Subsequently, the setup values are stored (ST13) and communication data is initialized (ST14). Then, the CPU 41 clears the RAM 78 at the game over time (ST15). Subsequently, whether or not a request for automatic medal inserted exists is determined (ST16). The case where a request for automatic medal inserted exists is when a winning game of replay is complete in the preceding game play. If a request for automatic medal inserted exists, as many medals as requested are automatically inserted (ST17) and a game play medal insertion command is transmitted (ST18)to the sub-control circuit 82and then the process proceeds to ST20. If a request for automatic medal inserted does not exist, medal inserted from the medal slot and the BET button is accepted (ST19) and the process proceeds to ST20.

At ST20, whether or not the start lever is on is determined. If the start lever is on, whether or not a time of 4.1 seconds has elapsed since the preceding game play is determined (ST21). Specifically, whether or not the time has elapsed is determined based on the value of a one-play monitor timer set at ST24 described later. If the time of 4.1 seconds has not elapsed since the preceding game play, the game start wait time is consumed (ST22) and the process proceeds to ST23.

At ST23, the CPU 41 extracts a random number for lottery. Specifically, the CPU 41 extracts one from the random numbers ranging from "0" to "16383". Subsequently, the one-play monitor timer is set (ST24) and gaming state monitor processing for determining the current gaming state is performed (ST25). Next, probability lottery processing is performed (ST26). In the probability lottery processing, the internal winning combination is determined based on the random number extracted at ST23 and the probability lottery table corresponding to the current gaming state determined in the gaming state monitor processing. In the probability lottery table, the random numbers corresponding to internal winning are predetermined for each winning combination as described above.

Next, the CPU 41 performs winning indicator lamp lighting lottery processing (ST27) and performs stop control table selection processing (described later in detail) (ST28). As transmission processing at the game play start time, a start command is transmitted to the sub-control circuit 82 (ST29) for initializing to start reel rotation (ST30).

Next, the CPU 41 determines whether or not the stop button is on (ST31). If the stop button is ON, the process proceeds to ST33; if the stop button is OFF, the process proceeds to ST32. At ST32, whether or not the value of an automatic stop timer is 0 is determined. If the value of the automatic stop timer is 0, the process proceeds to ST33; if the value of the automatic stop timer is not 0, the process proceeds to ST31. At ST33, the number of slide frames is determined from winning request (internal winning combination), the symbol position (rotation position of reel at the stop operation time), and the selected stop control table.

The reel is rotated for as many frames as the number of slide frames determined at ST33 (ST34). Next, a request for stopping the reel is set (ST35) and a reel stop command is transmitted the sub-control circuit 82 (ST36).

Whether all reels stop is determined (ST37). If all reels stop, the process proceeds to ST38; if not all reels stop, the process proceeds to ST31. Effect processing at the game over time is performed (ST38) and then winning game retrieval is executed (ST39). Subsequently, whether or not a winning game flag is normal is determined (ST40). If the winning game flag is normal, the process proceeds to ST42; if the winning game flag is not normal, an illegal error is indicated (ST41).

Next, whether or not the number of medals paid out for the winning game is 0 is determined (ST42). Specifically, whether or not the winning game of prize (except replay) is complete is determined. If the winning game is complete, medals are deposited or paid out in response to the state (during BB operation or during RB operation) and the winning combination (ST43).

Next, the CPU 41 determines whether or not the state is during BB or RB operation (ST44). If the state is during BB or RB operation, the process proceeds to ST45; if the state is not during BB or RB operation, the process proceeds to ST48. At ST45, the number of BB, RB games is checked. Whether or not BB exits is determined (ST46). When BB exits, a BB exit command is transmitted and then the RAM at the BB exit time is cleared (ST47) and the process proceeds to ST 49. If it is not determined at ST46 that BB exits, the process proceeds to ST49. If it is not determined at ST44 that the state is during BB or RB operation, BB, RB winning game check processing is performed (ST48) and the process proceeds to ST49. At ST49, bonus 7SEG control processing is performed and the process proceeds to ST15.

Next, the stop control table selection processing performed at ST28 will be discussed. To begin with, the CPU 41 determines whether or not the internal winning combination of the game is bell is determined (ST50). If the internal winning combination of the game is bell, the process proceeds to ST51; if the internal winning combination of the game is not bell, the process proceeds to ST52. At ST51, a random number is extracted and one stop control table is selected based on the stop control table selection table. At ST52, the stop control table predetermined for each internal winning combination is selected.

Hereinafter, control processing of the sub-control circuit 82 will be discussed with reference to FIGS. 26 through 34.

Figure 26:
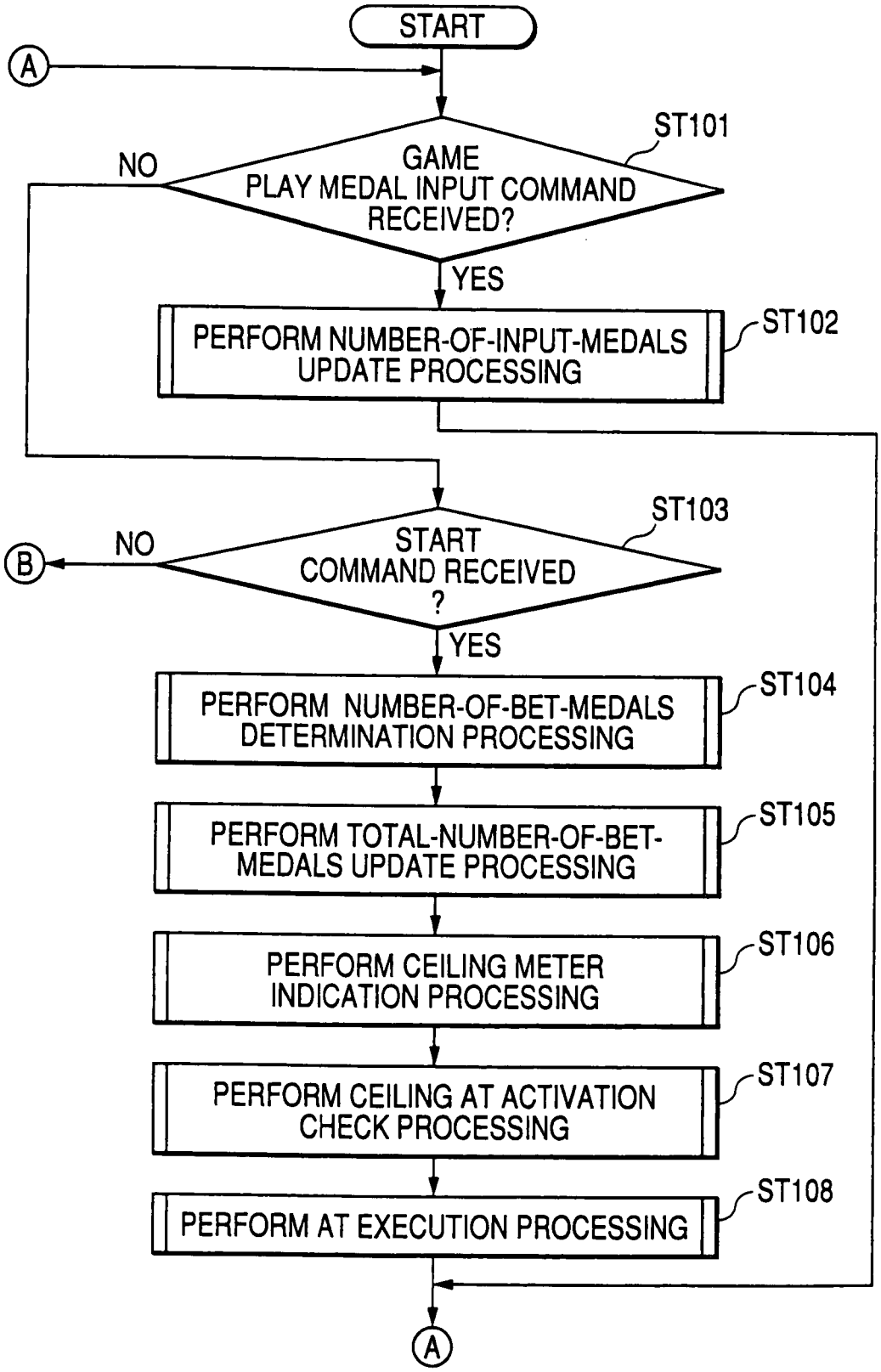
FIG. 26 is a flowchart to show processing of the sub-control circuit.
Figure 27:
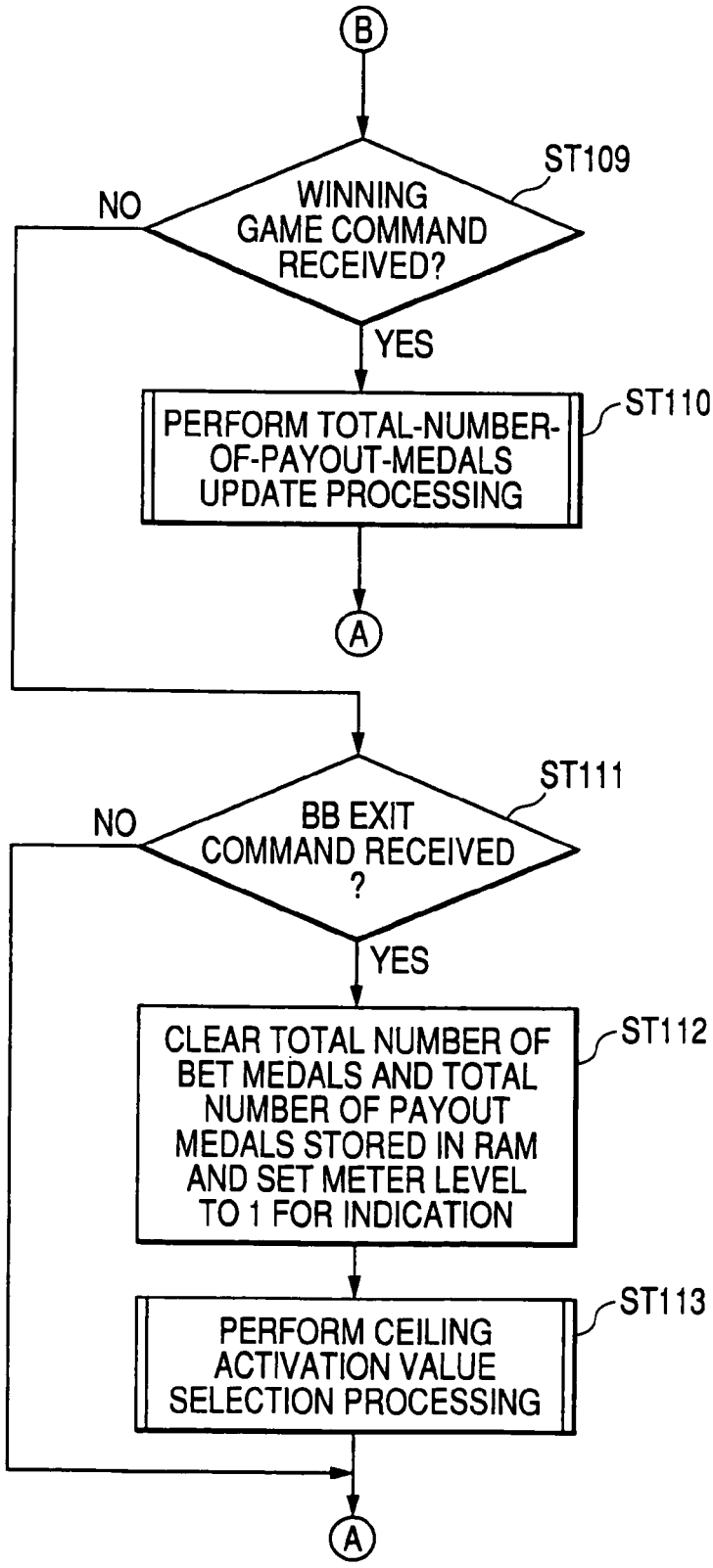
FIG. 27 is a flowchart to show processing of the sub-control circuit.

To begin with, an outline of the control processing of the sub-control circuit 82 will be discussed with reference to FIGS. 26 and 27. First, the sub-CPU 84 determines whether or not a game play medal insertion command is received, namely, whether or not game play medals used for playing one game have been inserted (ST101). The game play medal insertion command contains information indicating the number of inserted game play medals, etc. When the game play medal insertion command is received, the process proceeds to ST102. At ST102, the number of inserted medals changed during the start lever acceptance state is updated. Then, the process returns to ST101.

If a game play medal insertion command is not received, whether or not a start command is received, namely, whether or not one game is started is determined (ST 103). If a start command is received, the number of bet medals on the game (the number of used game medium) is determined (ST104) and then the total number of bet medals is updated (ST105). Next, processing concerning ceiling meter indication is performed (ST106), whether or not ceiling AT is to be activated is checked (ST107), and AT execution processing, namely, processing concerning push order notification is performed (ST108). Then, the process returns to ST101.

If it is not determined at ST103 that a start command is received, whether or not a winning game command is received, namely, whether or not a predetermined winning combination is won is determined (ST109) If a winning game command is received, the total number of paid-out medals is updated (ST109). Then, the process returns to ST101.

If it is not determined at ST109 that a winning game command is received, whether or not a BB exit command is received, namely, whether or not BB exits in the game is determined (ST111). If a BB exit command is received, the total number of bet medals and the total number of paid-out medals stored in the RAM are cleared and the scale of the ceiling meter is set to 1 for indication (ST112). As the total number of bet medals and the total number of paid-out medals are cleared, determination as to whether or not the relief measure is to be activated can be started after BB.

Ceiling activation value selection processing is performed for determining the next ceiling activation value (ST113). If it is not determined at ST111 that a BB exit command is received, ST112 and ST113 are skipped and the process returns to ST101.

FIGS. 28A through 28D describe the number-of-inserted-medals update processing at ST102, the number-of-bet-medals determination processing at ST104, the total-number-of-bet-medals update processing at ST105, and the total-number-of-payout-medals update processing at ST110.

Figure 28A:
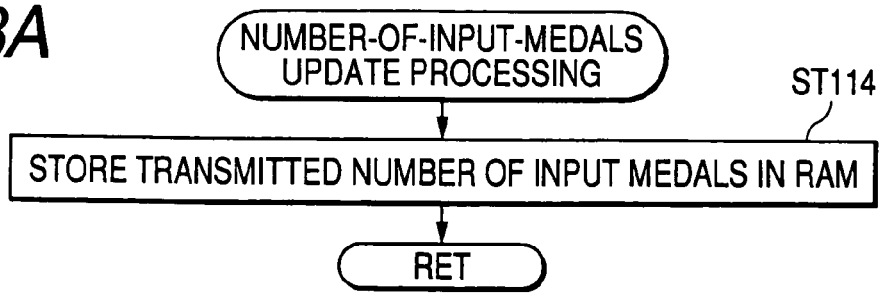
FIGS. 28A through 28D are flowcharts to show number-of-inserted-medals update processing, number-of-bet-medals determination processing, total-number-of-bet-medals update processing, and the total-number-of-payout-medals update processing.
Figure 28B:
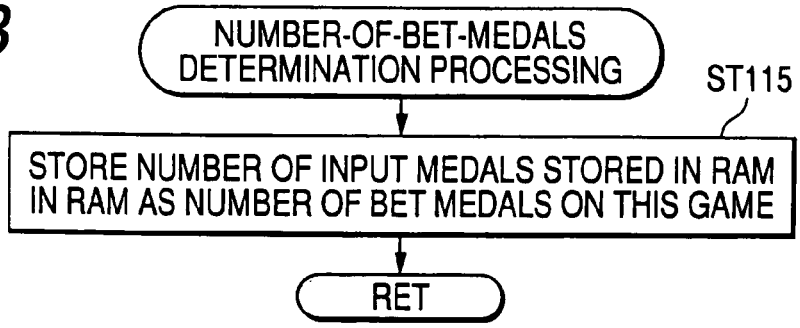

The number-of-inserted-medals update processing shown in FIG. 28A is to once store the transmitted number of inserted medals in a predetermined area of the RAM (ST110). The number-of-bet-medals determination processing shown in FIG. 28B is to determine that the number of inserted medals stored in the RAM at ST110 is the number of bet medals on the game and store the number of medals in the RAM (ST111). The reason why the number of inserted medals is monitored in the number-of-inserted-medals update processing and the number of bet medals is determined after the start command is received is that if the player operates the 1-BET switch 11, the 2-BET switch 12, or the MAX-BET switch 13 and inserts game play medals, the number of inserted medals can be changed before the player operates the start lever and therefore the number of bet medals must be determined when the player operates the start lever.

Figure 28C:
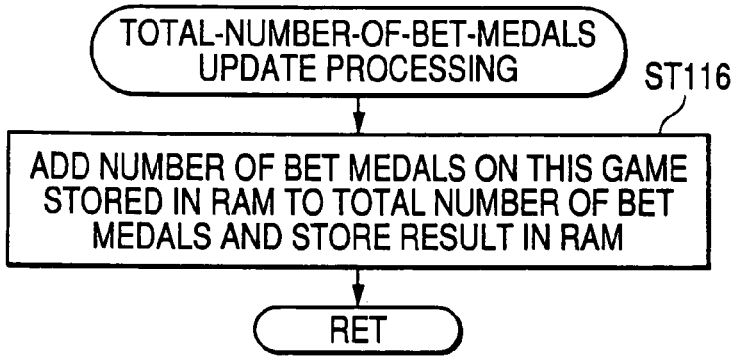
Figure 28D:
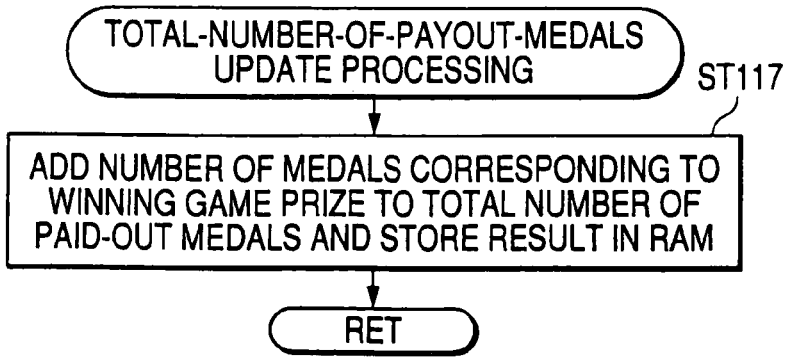

In the total-number-of-bet-medals update processing shown in FIG. 28C, the number of bet medals on the game determined at ST111 is added to the total number of bet medals (the number of used game medium)(ST116). For example, if the number of bet medals on the game is three, three is added. This processing is performed for each game, whereby it is made possible to calculate the total number of bet medals. In the total-number-of-payout-medals update processing shown in FIG. 28D, when medals are paid out, the number of paid-out medals is added to the total number of paid-out medals. For example, if the winning combination of plum is won, six is added; if the player does not win any games, "0" is added. This processing (ST117) is performed for each game, whereby it is made possible to calculate the total number of paid-out medals.

Figure 29:
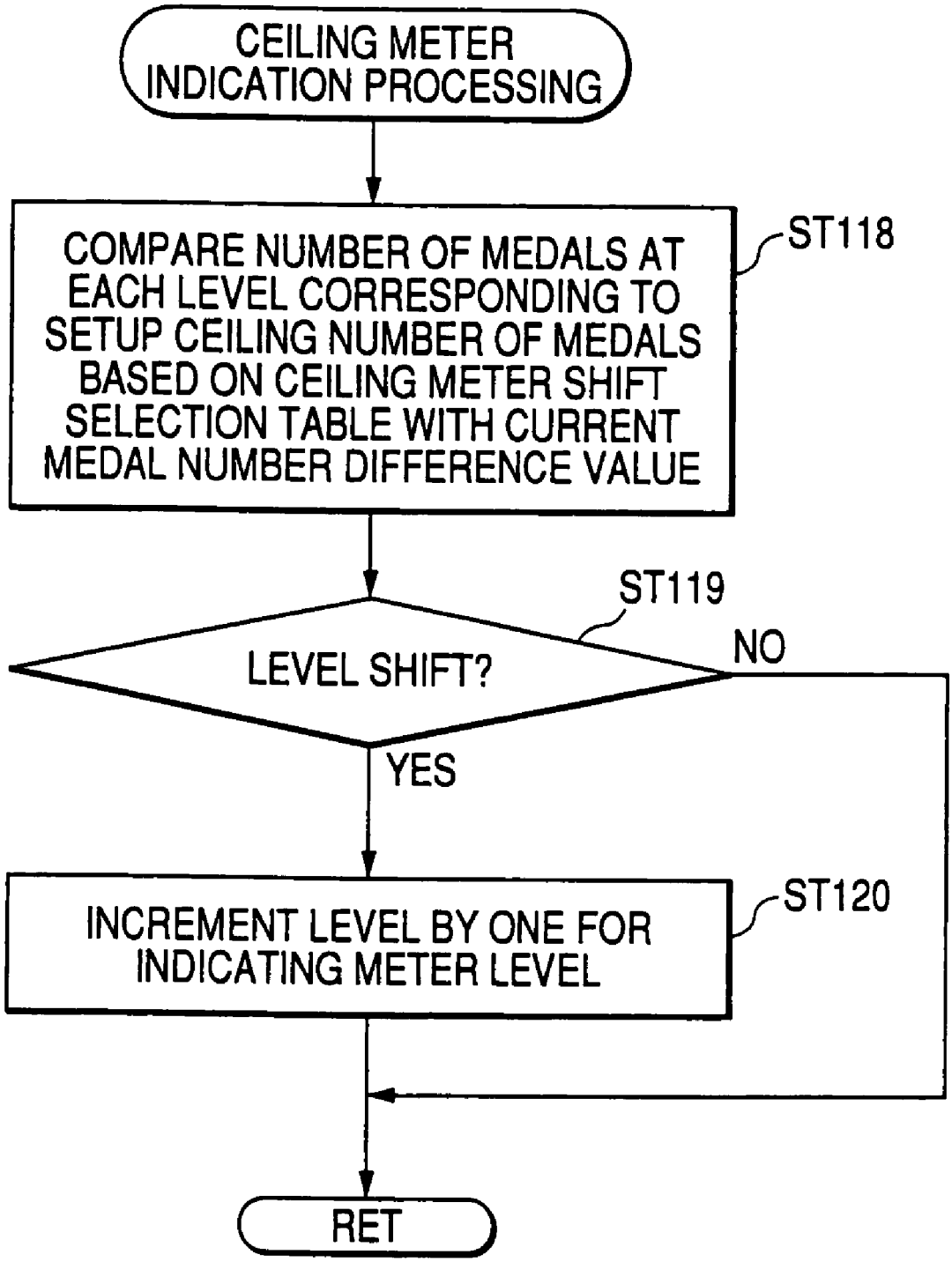
FIG. 29 is a flowchart to show ceiling meter indication processing.

FIG. 29 shows the ceiling meter indication processing at ST106. In the processing, first the indication level of the ceiling meter is determined based on the number of medals at each level corresponding to the setup ceiling number of medals based on the ceiling meter shift selection table and the current medal number difference value (ST118). Whether or not the current indicated level is to be shifted is determined (ST119). If the level is to be shifted, the current level is incremented by one for indicating the meter level (ST120); if the level is not to be shifted, the process is returned to the main routine.

Figure 30:
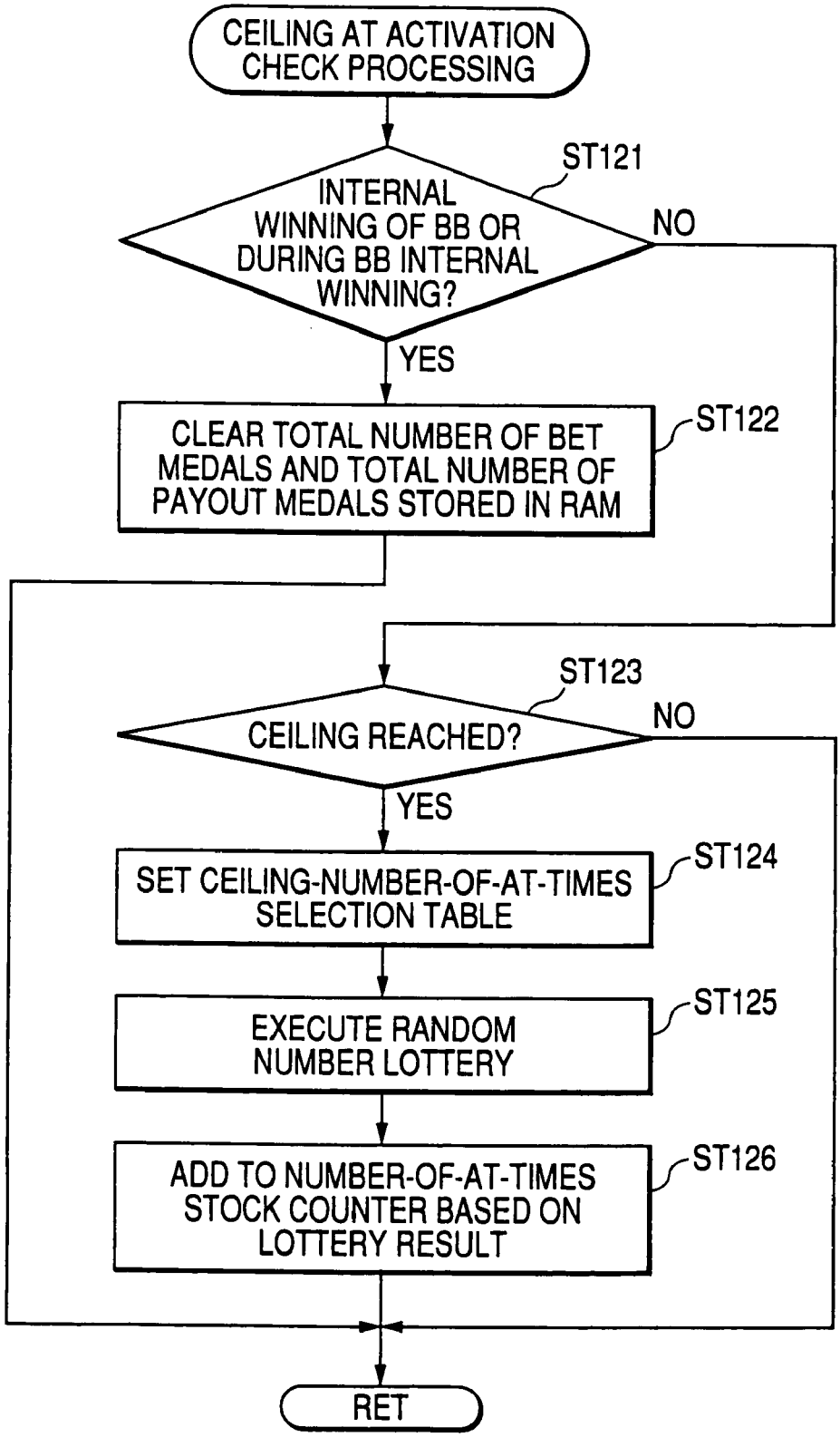
FIG. 30 is a flowchart to show ceiling AT activation check processing.

FIG. 30 shows the ceiling AT activation check processing at ST107. The ceiling AT refers to the stop operation assistance time period activated as a relief measure. The representation of "ceiling" is used because it is activated when a predetermined value (setup ceiling value) is reached. The predetermined value is determined in the ceiling activation value selection processing performed after BB exits; and is any one of "1200", "1500", or "1800".

In the ceiling AT activation check processing, first whether or not the internal winning of BB is accepted in the game or whether or not the current gaming state is during BB internal winning is determined (ST121). If the internal winning of BB is accepted in the game or the current gaming state is during BB internal winning, the total number of bet medals and the total number of paid-out medals stored in the RAM are cleared (ST122) and the process is returned to the main routine. In doing so, once the internal winning of BB is accepted, unless the BB exits, the relief measure is not activated.

If the internal winning of BB is not accepted in the game and the current gaming state is not during BB internal winning, whether or not the current medal number difference value reaches the setup ceiling value is determined (ST123). If the current medal number difference value is equal to or greater than the setup ceiling value, the ceiling-number-of-AT-times selection table is set (ST124), random number lottery is executed based on the table (ST125), and the value selected by the lottery is added to the number-of-AT-times stock counter (ST126). If it is determined at ST123 that the current medal number difference value is less than the setup ceiling value, the process is returned to the main routine.

Figure 31:
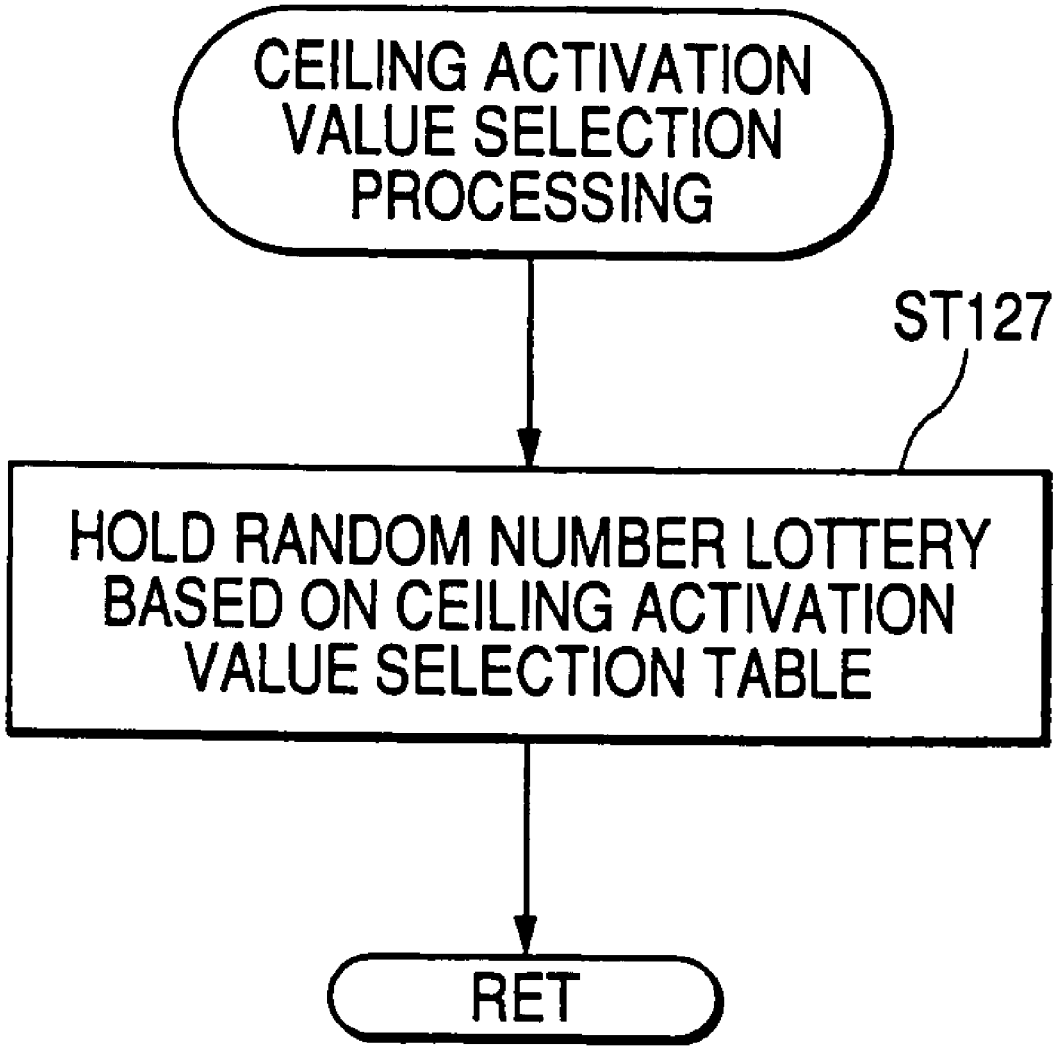
FIG. 31 is a flowchart to show ceiling activation value selection processing.

FIG. 31 shows the ceiling activation value selection processing at ST113. This processing is performed after BB exits for determining the number of games activated by the next relief measure, namely, the ceiling value. In the processing, a random number lottery is held (ST127) based on the ceiling activation value selection table, any value of 1200, 1500, or 1800 is selected, and the selected value is held in the RAM until the next BB exits and a new ceiling value is selected. The ceiling value is thus selected and determined, whereby the ceiling value is not fixed, making the player hard to determine when the next relieve measure will be activated.

Figure 32:
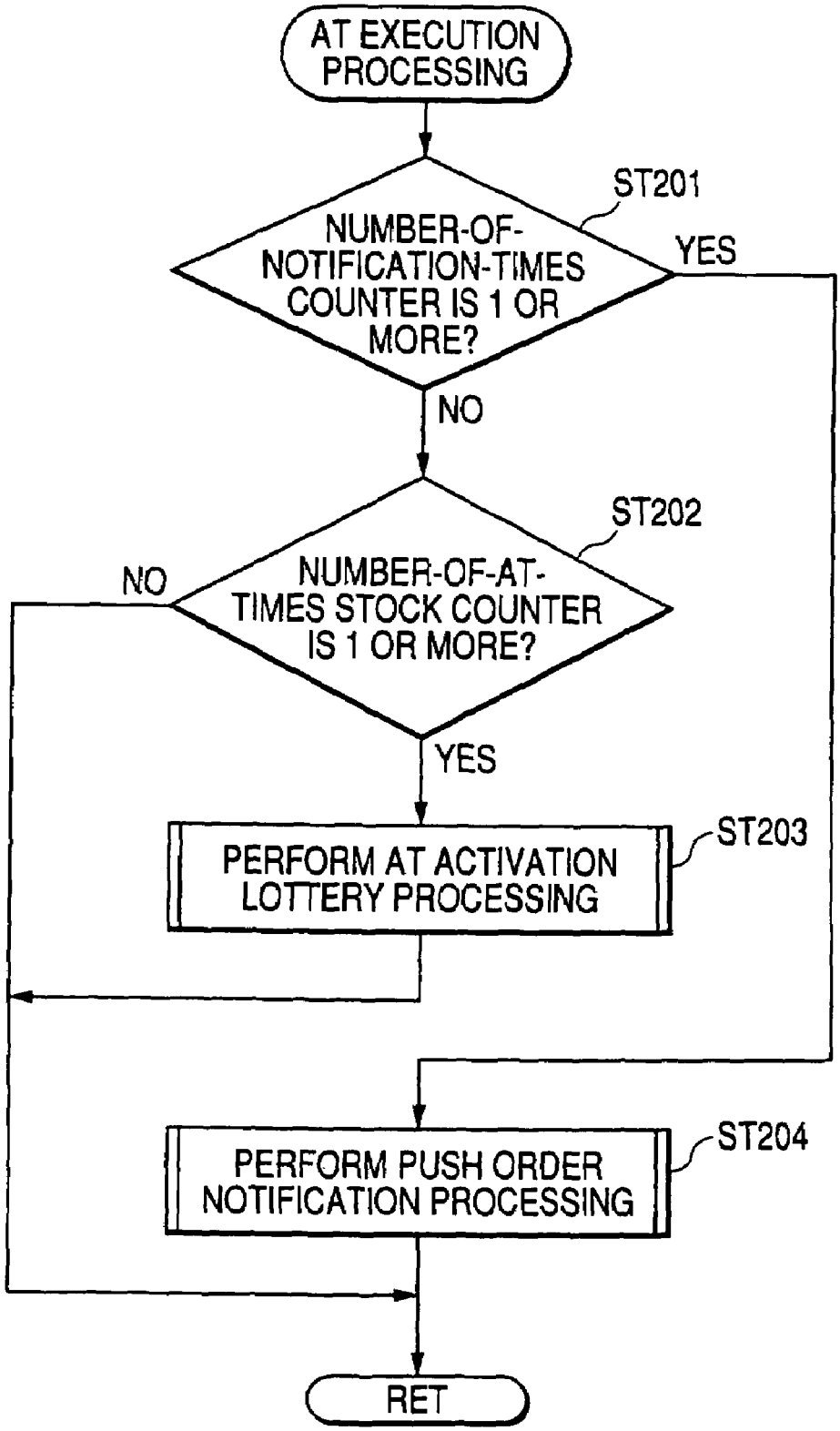
FIG. 32 is a flowchart to show AT execution processing.

FIG. 32 shows the AT execution processing at ST108.

First, whether or not the value of the number-of-notification-times counter is 1 or more is determined (ST201). If the number-of-notification-times counter is 1 or more, push order notification processing is performed (ST204). If the number-of-notification-times counter is less than 1, whether or not the value of the number-of-AT-times stock counter is 1 or more is determined (ST202). If the value of the number-of-AT-times stock counter is less than 1, the process is returned to the main routine; if the value of the number-of-AT-times stock counter is 1 or more, AT activation lottery processing is performed (ST203).

If the number-of-notification-times counter is 1 or more, it means that the gaming machine (player) is in the AT. If the value of the number-of-AT-times stock counter is 1 or more, it means that the AT is concealed.

Figure 33:
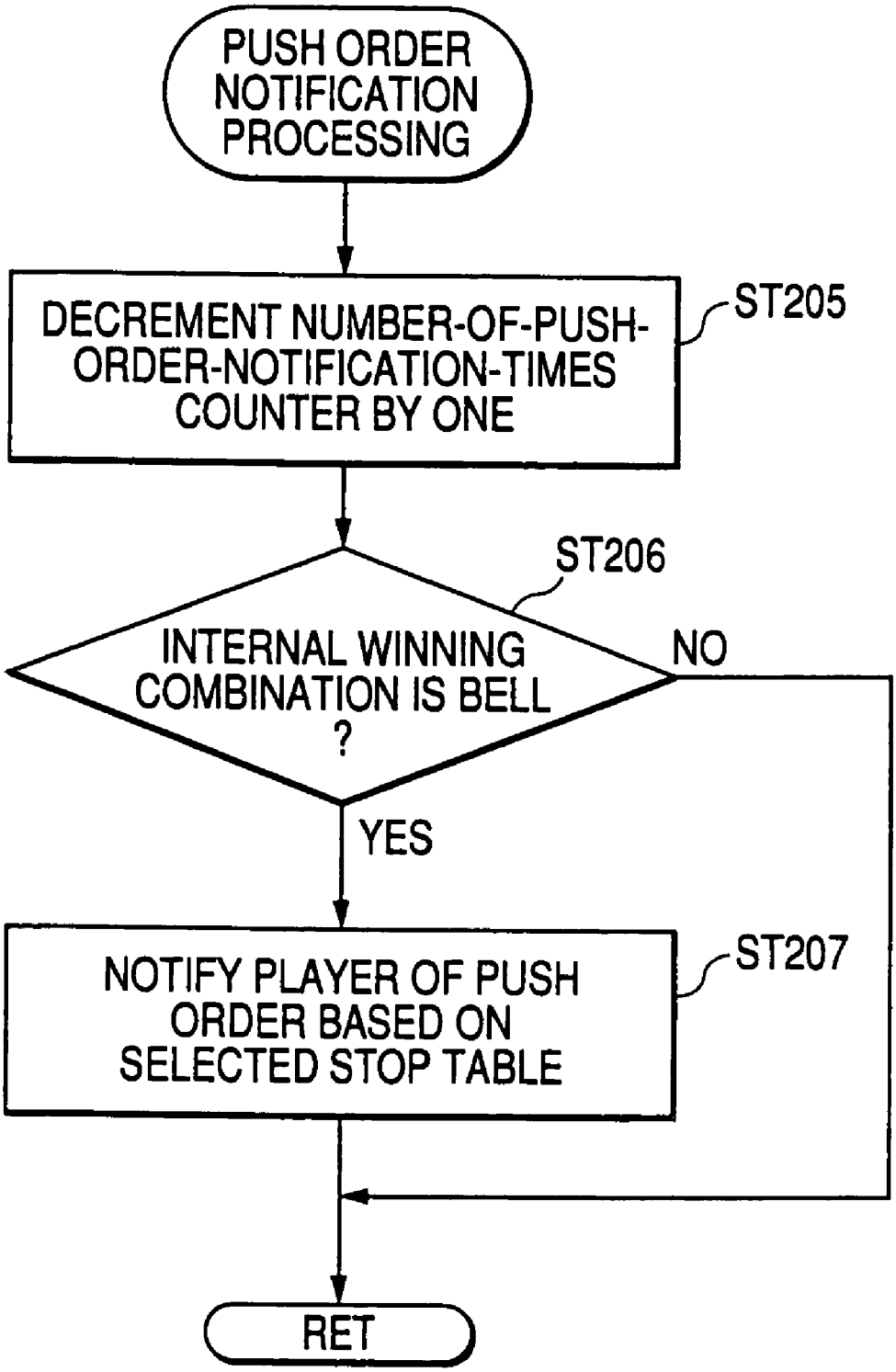
FIG. 33 is a flowchart to show push order notification processing.

FIG. 33 shows the push order notification processing at ST204. First, the number-of-push-order-notification-times counter is decremented by one (ST205). Whether or not the internal winning combination of the game is bell is determined (ST206). If the internal winning combination of the game is not bell, the process is returned to the main routine. If the internal winning combination of the game is bell, the player is notified of information to complete the winning game of bell based on the selected stop order control table number (ST207) and the process is returned to the main routine.

Figure 34:
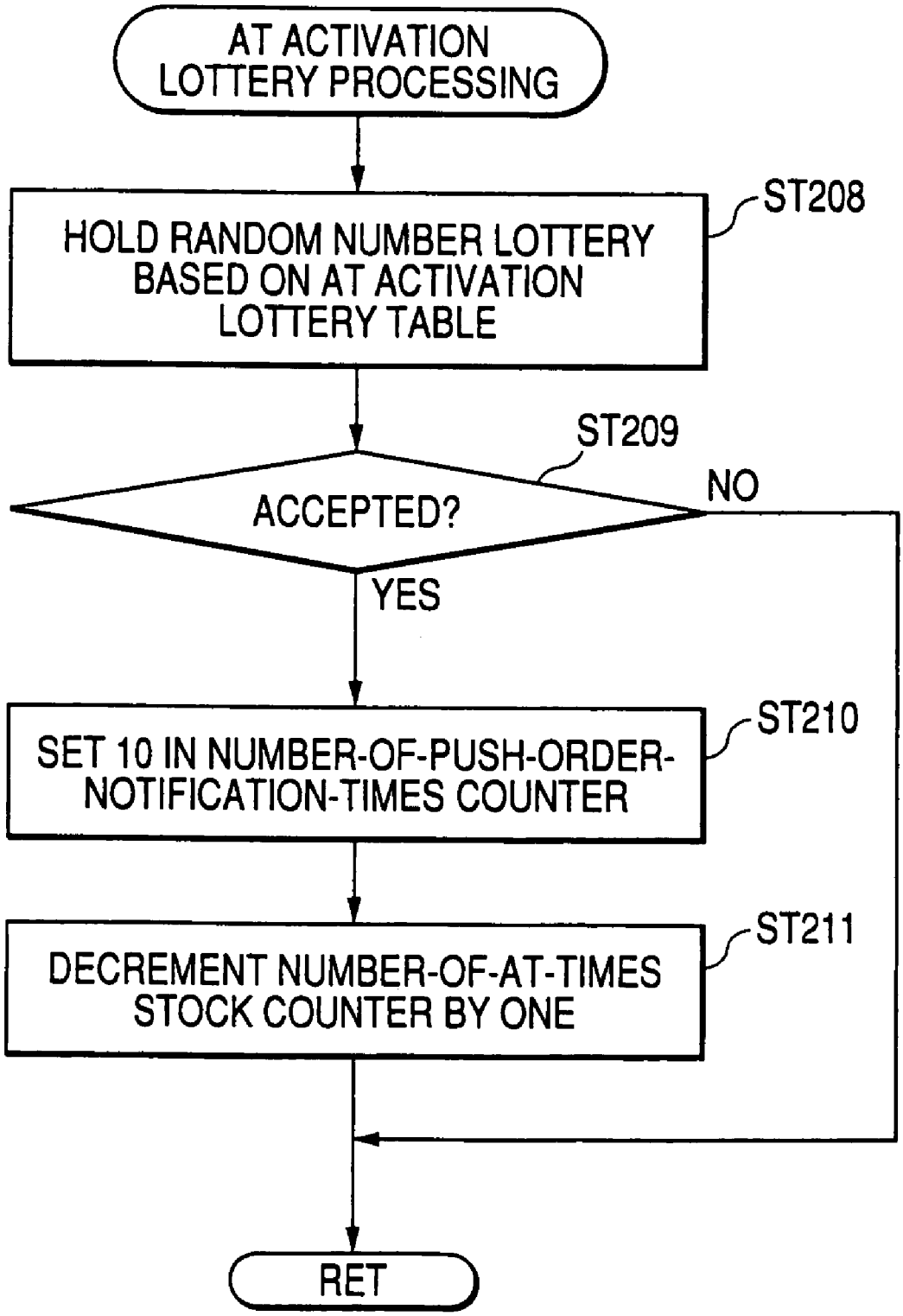
FIG. 34 is a flowchart to show AT activation lottery processing.

FIG. 34 shows the AT activation lottery processing at ST203.

First, a random number lottery is held based on the AT activation lottery table (ST208). Whether or not AT activation is accepted is determined as the result of the lottery (ST209). If AT activation is not accepted, the process is returned to the main routine. If AT activation is accepted, a value of 10 is added to the number-of-push-order-notification-times counter (ST210), the value of the number-of-AT-times stock counter is decremented by one (ST211), and the process is returned to the main routine.

In the processing described above, to produce various displays (indications) on the panel display unit 5, the first and second liquid crystal panels 501 and 502 are driven and controlled separately, whereby while the visibility of the portions of the rotation reels 3L, 3C, and 3R is maintained good, it is made possible to display information displayed on the display screen 5*a* more clearly and more extensively than in the related techniques and it is also made possible to scale up display, by the display scaling means as required, whereby a stronger impact is given to the player and the display can be vividly retained in the players memory.

The invention has been described with reference to the embodiments, but is not limited to the specific embodiments. In the embodiment, the total number of paid-out medals and the total number of bet medals are cleared when the internal winning of BB is accepted, during the internal winning of BB, or when the winning combination of BB is won. However, the timing can be set arbitrarily and the step of clearing the total number of paid-out medals and the total number of bet medals may be skipped.

In the embodiment, the stop operation assistance time period is activated each time the medal number difference value reaches the predetermined number of medals. However, the relief measure may be activated a predetermined number of times (for example, only once) after BB exits.

In the AT, the player is notified of the push order for the game whose winning is complete or incomplete depending on the push order. In addition, AT in which the player is notified of internal winning combination may be adopted. Further, as the advantageous situation for the user, BB, RB, etc., as well as AT can also be adopted if it enables the player to gain a large number of game medium.

Further, the invention can be applied not only to pinball slot machines as in the embodiments, but also to other types of gaming machines such as a pinball machine.

As described above, according to the invention, the gaming machine has variable display unit for producing various display of a plurality of symbols, front display unit being provided in front of the variable display means for enabling a player to see symbols on the variable display unit through the front display unit, the front display unit being capable of displaying various images, internal winning combination determination unit for determining an internal winning combination, a plurality of operation units for the player to stop the various display of the variable display unit, the stop control unit for performing stop control of the various display operation of the variable display unit based on the determination result of the internal winning combination determination unit and operation input through the operation unit, and game medium payout unit for paying out game medium to the player if the stop state of the variable display unit stopped by the stop control unit is a predetermined stop state, and also includes display scaling unit for making it possible to scale up or down display on the front display units and/or the variable display unit. Thus, a stronger impact is given to the player and as the image is scaled up, sharper display is produced, so that amusement of the gaming machine for the player to enjoy an effect image is still more enhanced and it is made possible for the player to be satisfied with playing a game without getting tired of the game.

Although only some exemplary embodiments of the invention have been described in detail above, those skilled in the art will readily appreciate that many modifications are possible in the exemplary embodiments without materially departing from the novel teachings and advantages of the invention. Accordingly, all such modifications are intended to be included within the scope of the invention.

What is claimed is:

1. A gaming machine comprising:

a first display device that variably displays a plurality of symbols having a normal size;

a second display device that electrically displays various images, the second display device being provided in front of the first display device and configured to enable the player to see the symbols displayed by the first display device therethrough;

an input device that allows a player to input a command to bet;

a controller that controls the first display device and the second display device in accordance with the command to provide a game to the player; and a display scaling unit that is disposed between the first display device and the second display device and moves between the first display device and the second display device to either enlarge the normal size of the plurality of the symbols displayed on the first display device when moved in a first direction or reduced the normal size of the plurality of the symbols displayed on the first display device when moved in a second direction being opposite of the first direction.

2. The gaming machine as claimed in claim 1, wherein the display scaling unit comprises a lens.

3. The gaming machine as claimed in claim 2, wherein the display scaling unit comprises a convex lens or a Fresnel lens.

4. The gaming machine as claimed in claim 2, wherein the display scaling unit moves the lens with respect to the first display device and the second display device.

5. The gaming machine as claimed in claim 4, wherein the display scaling unit moves the lens in back and forth direction.

6. The gaming machine as claimed in claim 1, wherein the first display unit is in a form of a liquid crystal panel.

7. The gaming machine as claimed in claim 1, wherein the second display unit is in a form of a liquid crystal panel.

8. The gaming machine as claimed in claim 2, wherein the display scaling unit comprises:

a front frame;

a rear frame;

a lens frame that supports the lens, the lens frame being disposed to be movable between the front frame and the rear frame;

an anchor pin that is provided on the lens frame;

a horizontal long hole that is formed on the front frame and regulates the movement of the anchor pin that is inserted therein;

an inclined long hole that is formed on the rear frame and allows the anchor pin to move along an inclined edge thereof, the anchor pin being inserted in the inclined long hole;

a long hole that is formed on the front frame at an upper portion;

an eccentric cam that has a circumferential edge that abuts an upper edge and a lower edge of the long hole; and a motor that has a shaft that is attached to the eccentric cam.

9. The gaming machine as claimed in claim 2, wherein the display scaling unit comprises:

a front frame;

a rear frame;

a motor;

a lens frame that supports the lens, the lens frame being disposed to be movable between the front frame and the rear frame;

a bolt shaft that is attached to the motor and penetrates the rear frame;

a screw boss that is provided on the lens frame and screwed into the bolt shaft; and a spring that is disposed between the lens frame and the front frame.

10. A gaming machine comprising:

a first display device that variably displays a plurality of symbols having a normal size;

a second display device that electrically displays various images having standard sizes, the second display device being provided in front of the first display device and configured to enable the player to see the symbols displayed by the first display device therethrough;

an input device that allows a player to input a command to bet;

a controller that controls the first display device and the second display device in accordance with the command to provide a game to the player; and a display scaling unit that includes a lens that is disposed between the first display device and the second display device and moves between the first display device and the second display device to either enlarge the normal size of the plurality of the symbols displayed on the first display device when moved in a first direction or reduce the normal size of the plurality of the symbols displayed on the first display device when moved in a second direction being opposite of the first direction.

11. The gaming machine as claimed in claim 10, wherein the display scaling unit is disposed in front of the second display device.

12. The gaming machine as claimed in claim 11, wherein, when the display scaling unit moves between the first display device and the second display device, the standard sizes of the various images displayed on the second display device are either enlarged or reduced.

13. The gaming machine as claimed in claim 11, wherein the display scaling unit is configured to scale up or down the symbols displayed on the first display device and the various images displayed on the second display device.

14. The gaming machine as claimed in claim 10, wherein the display scaling unit comprises a convex lens or a Fresnel lens.

15. The gaming machine as claimed in claim 10, wherein the display scaling unit moves the lens with respect to the first display device and the second display device.

16. The gaming machine as claimed in claim 15, wherein the display scaling unit moves the lens in back and forth direction.

17. The gaming machine as claimed in claim 10, wherein the display scaling unit comprises:

a front frame;

a rear frame;

a lens frame that supports the lens, the lens frame being disposed to be movable between the front frame and the rear frame;

an anchor pin that is provided on the lens frame;

a horizontal long hole that is formed on the front frame and regulates the movement of the anchor pin that is inserted therein;

an inclined long hole that is formed on the rear frame and allows the anchor pin to move along an inclined edge thereof, the anchor pin being inserted in the inclined long hole;

a long hole that is formed on the front frame at an upper portion;

an eccentric cam that has a circumferential edge that abuts an upper edge and a lower edge of the long hole; and a motor that has a shaft that is attached to the eccentric cam.

18. The gaming machine as claimed in claim 10, wherein the display scaling unit comprises:

a front frame;

a rear frame;

a motor;

a lens frame that supports the lens, the lens frame being disposed to be movable between the front frame and the rear frame;

a bolt shaft that is attached to the motor and penetrates the rear frame;

a screw boss that is provided on the lens frame and screwed into the bolt shaft; and a spring that is disposed between the lens frame and the front frame.

* * * * *